US012623315B2

(12) United States Patent
Barth

(10) Patent No.: US 12,623,315 B2
(45) **Date of Patent: *May 12, 2026**

(54) QUICK CLAMPING DEVICE

(71) Applicant: Robert Bosch GmbH, Stuttgart (DE)

(72) Inventor: Daniel Barth, Leinfelden-Echterdingen (DE)

(73) Assignee: Robert Bosch GmbH, Stuttgart (DE)

( * ) Notice: Subject to any disclaimer, the term of this patent is extended or adjusted under 35 U.S.C. 154(b) by 670 days.

This patent is subject to a terminal disclaimer.

(21) Appl. No.: 17/782,657

(22) PCT Filed: Dec. 10, 2020

(86) PCT No.: PCT/EP2020/085579

§ 371 (c)(1),
(2) Date: Jun. 5, 2022

(87) PCT Pub. No.: WO2021/130026

PCT Pub. Date: Jul. 1, 2021

(65) Prior Publication Data

US 2022/0388109 A1 Dec. 8, 2022

(30) Foreign Application Priority Data

Dec. 23, 2019 (DE) ..... 10 2019 220 539.9

(51) Int. Cl.
*B24B 23/02* (2006.01)
*B24B 45/00* (2006.01)

(52) U.S. Cl.
CPC ..... *B24B 23/022* (2013.01); *B24B 45/006* (2013.01)

(58) Field of Classification Search
CPC ... B24B 45/006; B24B 23/022; B24B 23/028; B27B 5/32

(Continued)

(56) References Cited

U.S. PATENT DOCUMENTS

| | | | |
|---|---|---|---|
| 5,601,483 A | 2/1997 | Rudolf et al. | |
| 2013/0180747 A1 | 7/2013 | Brown et al. | |
| 2015/0042052 A1* | 2/2015 | Furusawa | B23B 31/10 279/141 |

FOREIGN PATENT DOCUMENTS

| | | |
|---|---|---|
| CN | 109843506 A | 6/2019 |
| DE | 10 2012 007 926 A1 | 10/2013 |

(Continued)

OTHER PUBLICATIONS

WO-2018072996-A1 English Translation obtained from EspaceNet (Year: 2018).*

(Continued)

*Primary Examiner* — Makena S Markman
(74) *Attorney, Agent, or Firm* — Maginot, Moore & Beck LLP

(57) ABSTRACT

A quick clamping device for positioning an accessory device on a hand-held power tool such as an angle grinder. The quick clamping device includes a drive output unit for moving the accessory device about a drive output axis of the drive output unit. The quick clamping device further includes a retaining unit for retaining the accessory device on the hand-held power tool. The retaining unit has a retaining element. The retaining unit has a retaining parameter which changes in a retaining state, in particular in the event of a transition from a retaining state to a clamping state.

19 Claims, 14 Drawing Sheets

(58) Field of Classification Search
USPC ..... 451/344, 359
See application file for complete search history.

(56) References Cited

FOREIGN PATENT DOCUMENTS

| | | | | | |
|---|---|---|---|---|---|
| DE | 10 2012 007 931 | A1 | | 10/2013 | |
| DE | 11 2013 000 831 | T5 | | 10/2014 | |
| DE | 10 2017 214 117 | A1 | | 2/2019 | |
| EP | 0 650 805 | A1 | | 5/1995 | |
| EP | 2 017 036 | A1 | | 1/2009 | |
| EP | 2 799 188 | A1 | | 11/2014 | |
| JP | 2001-502612 | A | | 2/2001 | |
| JP | 2009-23083 | A | | 2/2009 | |
| WO | 2013/065614 | A1 | | 5/2013 | |
| WO | WO-2018072996 | A1 | * | 4/2018 | ..... B24B 23/02 |
| WO | 2018/188870 | A1 | | 10/2018 | |

OTHER PUBLICATIONS

International Search Report corresponding to PCT Application No. PCT/EP2020/085579, mailed Mar. 18, 2021 (German and English language document) (5 pages).

* cited by examiner

QUICK CLAMPING DEVICE

This application is a 35 U.S.C. § 371 National Stage Application of PCT/EP2020/085579, filed on Dec. 10, 2020, which claims the benefit of priority to Serial No. DE 10 2019 220 539.9, filed on Dec. 23, 2019 in Germany, the disclosures of which are incorporated herein by reference in their entirety.

The disclosure relates to a quick clamping device.

BACKGROUND

DE 10 2012 007 926 A1 relates to a power-driven hand tool having a housing having a spindle head, having a tool spindle that is drivable about its longitudinal axis, in particular that is drivable in rotational oscillation, wherein the tool spindle has a tool-side end with a retaining portion for a tool to be driven, and having a clamping device, having a fastening element, wherein the clamping device has a clamping configuration, in which the tool is able to be fixed to the tool spindle by means of the fastening element, and a releasing configuration, in which the tool is detachable, and wherein the clamping device is able to be switched over between the clamping configuration and the releasing configuration by means of a codirectional adjusting movement.

SUMMARY

The disclosure is based on the object of improving a quick clamping device with simple design measures.

The object is achieved by a quick clamping device for arranging an accessory device on a hand-held power tool, in particular on an angle grinder, having an output unit for moving the accessory device about an output axis A of the output unit and having a retaining unit, having in particular a retaining element, for retaining the accessory device on the hand-held power tool.

It may be expedient when the retaining unit has a retaining parameter which changes in a retaining state, in particular during a transition from a retaining state into a clamping state.

The retaining unit may be settable such that a retaining parameter is changed in a retaining state, in particular during a transition from a retaining state into a clamping state, of the retaining unit.

By way of the quick clamping device according to the disclosure, an accessory device can be received and retained on the hand-held power tool in a particularly reliable and quick way. Particularly preferably, accessory devices with different thicknesses of a receiving region can be reliably received and clamped. It is also possible to ensure that accessory devices with different thicknesses can be retained with in each case a more or less uniform clamping force on the quick clamping device.

Furthermore, a particularly high level of operating comfort can be achieved in that easy mounting and/or removal of an accessory device on and/or from the quick clamping device or the hand-held power tool is allowed. In addition, the accessory device can be attached to the quick clamping device and removed therefrom again in a particularly time-saving manner without it being necessary to dispense with secure reception of the accessory device.

Furthermore, the accessory device can be retained particularly reliably on the quick clamping device, such that the accessory device is secured against detaching by itself and/or unintentionally.

As a result of a change in a retaining parameter, the accessory device can be transferred particularly easily from a retaining state into a clamping state. The retaining parameter of the retaining unit can be intended to transfer the retaining unit, for example by means of a rotary movement, from a releasing state into a retaining state, in particular in order to retain the accessory device on the quick clamping device or on the hand-held power tool. Furthermore, the retaining parameter of the retaining unit can be intended to transfer the retaining unit, for example by means of a movement in translation along the output axis, from a retaining state into a clamping state, in particular in order to clamp the accessory device to the quick clamping device or to the hand-held power tool. Particularly advantageously, separation of the functions can be achieved as a result, in that the retaining unit is transferred from a releasing state into a retaining state, in order to retain the accessory device on the quick clamping device or on the hand-held power tool by way of a form fit, and in that the retaining unit is transferred from a retaining state into a clamping state, in order to clamp the accessory device in particular along the output axis. As a result of a retaining parameter of the retaining unit being changed in a retaining state, a direction of movement of the retaining unit, in particular of the retaining element, can be changed.

A retaining parameter should be understood as meaning in particular a degree of freedom of movement which preferably forms, in the mechanical sense, a number of the mutually independent possible movements. The retaining parameter can define a movement, in particular a direction of movement, of at least one retaining element. The retaining parameter can define a rotary movement about the output axis. The retaining parameter can define a movement in translation along the output axis. A change in the retaining parameter can take place in that, for example, a rotary movement about the output axis is prevented or stopped and/or a movement in translation along the output axis is enabled or started. Preferably, the retaining unit is intended to control a retaining movement, in particular a change in a retaining movement, of the retaining unit, in particular during a transition from a retaining state into a clamping state. In particular, the retaining parameter can change during a transition from a retaining state into a clamping state.

The retaining unit can be intended to retain the accessory device on the quick clamping device or the hand-held power tool by way of a form fit and/or a force fit.

The retaining unit can have at least two elements which are mounted so as to movable with respect to one another at least in one state. The two elements can be arranged with respect to one another such that the accessory device is retained in an axial direction on the quick clamping device. The two elements can be intended to transfer a clamping force to the accessory device by means of a clamping unit. Preferably, the clamping force corresponds at least to a retaining force which is intended to retain the accessory device on the retaining unit, in particular on the quick clamping device, in an operating state of the quick clamping device or of the hand-held power tool. The two elements can be mounted so as to be movable with respect to one another in an axial direction along the output axis, in order to clamp the accessory device in the axial direction. The retaining unit can in this case have a retaining element. The retaining element can be intended to engage through the accessory device, in particular a cutout in the accessory device, and to retain the accessory device on the quick clamping device or the output unit by way of a form fit and/or a force fit. The retaining element can have a retaining wing which extends, preferably outwardly, in a radial direction with respect to the output axis. The retaining element can be mounted so as to be movable in an axial direction along the output axis in order to clamp or release the accessory device by means of the movement in the axial direction. The retaining element may have a retaining contour which corresponds approximately to a receiving cutout, in particular a receiving contour of a receiving cutout, of the accessory device. The retaining contour can be outlined by contours of the retaining wings. The retaining contour can be configured so as to correspond approximately to the receiving contour. The retaining contour can be configured to be smaller than the receiving contour. The retaining element can be configured such that the retaining contour fits through the receiving contour, in order for it to be possible to plug the retaining element through the receiving cutout of the accessory device. The retaining element can be intended to engage by means of the retaining wing through the receiving cutout of the accessory device and to retain the accessory device. In particular, the retaining element can be twisted with respect to the receiving cutout such that the retaining wing forms a form with the accessory device. The retaining contour can be orientable with respect to the receiving contour such that, in a first rotary position, the retaining contour covers the receiving contour, such that the retaining element is able to be plugged through the receiving cutout and, upon rotation about the output axis into a second rotary position, the retaining contour overlaps the receiving contour of the receiving cutout.

Preferably, the output unit is intended to transmit a rotational and/or oscillatory movement about the output axis to an accessory device retained on the output unit by means of the retaining unit. Preferably, the output unit is operatively connected to a drive unit of the hand-held power tool in a manner already known to those skilled in the art, in particular via at least one drive pinion of the drive unit. The output unit comprises in particular at least one sleeve and/or at least one hollow shaft, in particular a hollow spindle. The rotational and/or oscillatory movement of the output unit is preferably able to be generated as a result of cooperation of the output unit with the drive unit of the hand-held power tool, which comprises at least one electric motor. In particular, the retaining element is mounted so as to be unable to be removed. This is intended to be understood in particular as meaning that the component, in particular the retaining element is arranged captively on at least one further component, in particular on the output unit, and/or preferably is inseparable in particular from the output unit in the functional and/or operational state, in particular in a releasing state (unclamped state) of the quick clamping device and in a clamping state (clamped-in-place state) of the quick clamping device. Preferably, the retaining element is arranged captively on the output unit. In particular, the retaining element arranged captively on the output unit and/or each further component arranged captively on the output unit is connected captively to the output unit, in particular in the open state and/or in the closed state of the quick clamping device. In particular, the retaining element is intended to be able to be plugged through the accessory tool, depending on the rotary position of the retaining element, and in the event of a change in the rotary position to form a form fit, in particular in an axial direction along the output axis, with the accessory device. A "releasing state" of the quick clamping device should be understood as meaning in particular a state of the quick clamping device which is intended to release an accessory device arranged on the quick clamping device for removal and/or to release the quick clamping device for mounting an accessory device on the quick clamping device. The releasing state can form a bottom dead center of the quick clamping device. A "retaining state" of the quick clamping device should be understood as meaning in particular a state of the quick clamping device in which an accessory device is retained on the output unit of the quick clamping device or of the hand-held power tool by way of a form fit and is preferably secured against falling out. A "clamping state" of the quick clamping device should be understood as meaning in particular a state of the quick clamping device in which the accessory device is intended to be transferred into a state fixed to the output unit preferably by means of a clamping movement and/or is fixed to the output unit so as to be operational. The clamping state can form a top dead center of the quick clamping device, in which the accessory device is in a clamped-in-place state on the output unit. Preferably, the accessory device can be fixed to the output unit so as to be operational and/or removal of an accessory device from the output unit may be impossible, in particular without destroying it. In particular, the retaining state may comprise the clamping state, and in particular, the clamping state can form a specific form of the retaining state in that the retaining state also comprises a function retaining the accessory device. The retaining element is intended, in particular in the clamping state of the quick clamping device, to generate a force fit and/or for fit for retaining an accessory device, in particular a grinding wheel, on the quick clamping device. In particular, a clamping state should be understood as meaning that the quick clamping device generates a clamping movement for generating the force fit and/or form fit for retaining an accessory device. Preferably, the retaining element generates an, in particular axial, form fit, preferably by means of at least a part of the accessory device being pressed against at least a part of the output unit. It is conceivable for the retaining element, in particular in addition to the axial form fit, to generate a form fit in a radial direction and/or in a circumferential direction, wherein the circumferential direction lies in a plane, the surface normal of which extends parallel to the output axis. In particular, the accessory device is fixed to the quick clamping device without tools. The expression "fixable without tools" should be understood as meaning in particular that a process of arranging an accessory device on the quick clamping device and/or a switchover between the releasing state and the clamping state is possible independently of the use of an external tool, for example a wrench, a hex wrench or the like. The retaining element is mounted in particular so as to be movable in translation in an axial direction along the output axis and/or in rotation about the output axis, in particular in relation to the output unit, wherein preferably an axis of movement, in particular an axis of rotation, of the retaining element coincides at least substantially with the output axis. The output unit engages at least partially around the retaining element, in particular along a circumferential direction that lies in a plane, the surface normal of which extends at least substantially parallel to the output axis. Preferably, the output unit comprises a hollow shaft for at least partially receiving the retaining element. In particular, such a quick clamping device can advantageously be embodied in a compact manner, with the result that it may be possible to mount small application tools, for example application tools with a diameter of 100 mm or less.

The accessory device can be in the form of a grinding wheel and/or of a cut-off wheel.

The disclosure includes further expedient developments of the a quick clamping device.

It may be expedient when the retaining unit, in particular the retaining element, is mounted in the retaining state so as to be rotatable substantially about the output axis and/or is mounted in a/the clamping state so as to be movable substantially along the output axis. Furthermore, it may be expedient when the retaining unit, in particular the retaining element, has a clamping state in which the retaining element is mounted so as to be movable substantially along the output axis. In the retaining state, the retaining unit can be mounted so as to be rotatable about the output axis and/or movable along the output axis. In the clamping state, the retaining unit can be mounted so as to be rotatable about the output axis and/or movable along the output axis. In particular, the retaining unit can be mounted in the retaining state or in the clamping state so as not to be rotatable about the output axis or not to be movable along the output axis. Separation of the functions can be achieved in that the retaining unit is mounted for example a retaining state so as to be rotatable about the output axis or rotatable about the output axis and movable in translation along the output axis. Separation of the functions can furthermore be achieved in that the retaining unit is mounted for example in a clamping state so as to be movable in translation along the output axis or movable in translation along the output axis and rotatable about the output axis. A change in the retaining parameter can in this case take place by way of a change in a degree of freedom of the retaining unit, in particular of the retaining element, in that for example a rotational movement is prevented and a movement in translation is enabled.

It may be expedient when a movement of the retaining element, in particular of the retaining element with respect to a spindle element, along the output axis is prevented in a retaining state of the retaining unit. The retaining element can be mounted so as to be movable about the output axis from a releasing state as far as a transition from the retaining state into the clamping state or as far as the clamping state. The retaining element can be mounted in a clamping state so as to be movable along the output axis.

Furthermore, it may be expedient when a movement of the retaining element, in particular of the retaining element with respect to a spindle element, about the output axis is prevented in a clamping state of the retaining unit. The retaining element can be mounted so as to be movable along the output axis from a releasing state as far as a transition from the retaining state into the clamping state or as far as the clamping state. The retaining element can be mounted in a retaining state so as to be movable about the output axis.

Preferably, the retaining element is mounted so as to be movable with respect to a spindle element, in order to transfer the quick clamping device from a releasing state into a clamping state.

As a result, it is possible to ensure that a movement required for the function of the respective state is enabled and a movement that is not required or not absolutely required is prevented.

To fix the accessory device, the retaining unit, in particular the retaining element, can be rotated through an angle about the output axis from a releasing state (bottom dead center) to a clamped-in-place clamping state (top dead center). The angle can comprise a range of 0° to 25°, in particular to 30°, preferentially to 40°, preferably to 50°, particularly preferably to 55°, more preferably to 60°, even more preferably to 65°. For example, the angle may comprise a range from 0° to 40°, preferably with a tolerance of +20° to −10°. For example, the angle may comprise a range from 0° to 32°, preferably with a tolerance of +/−8°. For example, the angle may comprise a range of 0° to 48°, preferably with a tolerance of +/−16°.

It may be expedient when the retaining unit has a retaining element which is intended to engage through the accessory device and to clamp the accessory device. The retaining element can, in particular in a releasing state, extend through the accessory device and, in particular in a retaining state, be rotated with respect to the accessory device for example by means of a rotary movement about the output axis, in order to retain the accessory device by way of a form fit. The retaining element can preferably have a retaining wing which extends in a radial direction with respect to an output axis. The retaining wing can be intended to engage around the accessory device at least partially along a slope. The retaining wing can be intended to exert a clamping force on the accessory device. The retaining wing may have a retaining face. The retaining face may extend along a radial plane of the output axis. As a result, the accessory device can be connected to the quick clamping device, in particular the output unit, particularly easily and reliably.

It may furthermore be expedient when the retaining unit is intended to transfer the accessory device from a releasing state into a retaining state or a clamping state by means of a rotary movement of the retaining unit, in particular of the retaining element with respect to the spindle element, about the output axis A.

It may be expedient when the quick clamping device has a clamping unit, in particular a clamping element, which is intended to move the retaining unit, in particular the retaining element, axially along the output axis A. The clamping unit may be coupled to the retaining unit. The clamping unit may be intended to clamp the accessory device in an axial direction by means of the retaining unit, in particular to transfer it from a retaining state into a clamping state.

The clamping unit may be intended to transmit a clamping force, in particular axially along the output axis, to the accessory device. The clamping unit may have a clamping element which is intended to control an axial movement of the retaining unit, in particular of the retaining element. The clamping unit may be intended to brace the accessory device in an axial direction along the output axis by means of a movement or a rotary movement, in particular of the clamping element, about the output axis.

The clamping unit may have a further clamping element which is intended to cooperate indirectly or directly with the clamping element. The clamping element and the further clamping element may form a thread or a ramp, which is intended to transmit a clamping force, in particular axially along the output axis, to the accessory device. The further clamping element may be mounted so as to be movable with respect to the clamping element. The further clamping element may be formed on a further element of the clamping unit.

Furthermore, it may be expedient when the clamping unit has a sloping element, in particular in the form of a thread element or of a ramp element. A sloping element should be understood as meaning in particular an element which has a slope, in particular in a circumferential direction about the output axis. For example, the sloping element may form a thread or a threaded portion. The sloping element may be configured in the manner of a wedge element. The sloping element may be intended to convert a movement for example along the sloping element or in a circumferential direction about the output axis into a movement transversely, in particular perpendicularly, to the sloping element or in an axial direction along the output axis. The sloping element may have a varying or constant slope. The sloping element may be formed with a monotonic, in particular strictly monotonic slope.

The clamping unit may have a single sloping element or a plurality of sloping elements. The sloping elements may follow one another in a circumferential direction. The sloping elements may be arranged in series with one another in a circumferential direction. The sloping elements may be arranged parallel to one another. The sloping elements may be spaced apart from one another in a circumferential direction. The sloping elements may be delimited by two radial planes which are extend radially with respect to the output axis and/or are arranged parallel to one another. In particular, the two radial planes can delimit each first sloping element. Preferably, a spacing of the two radial planes can be delimited by a maximum axial extent of the sloping element or of the sloping elements or of a sloping portion of the sloping element(s). The two radial planes may be at a spacing from one another which corresponds substantially to a maximum axial movement of the retaining element along the output axis from a releasing state to a clamping state.

Furthermore, it may be expedient when the sloping element has a first sloping portion and a second sloping portion that is angled with respect to the first sloping portion. The first sloping portion may extend in a radial plane of the output axis. The first sloping portion may be formed in a planar manner. The first sloping portion may preferably not have a slope in a circumferential direction about the output axis. The first sloping portion may extend, in particular entirely, along a radial plane of the output axis. It is conceivable for the first sloping portion to be angled with respect to a radial plane of the output axis. The second sloping portion may be angled with respect to a radial plane of the output axis. By means of the sloping element, in particular the first sloping portion and the second sloping portion of the sloping element, the retaining parameter of the retaining unit can be changed.

Furthermore, it may be expedient when the clamping unit has a further sloping element, in particular in the form of a thread element or a ramp element. The further sloping element may be assigned to the sloping element. The further sloping element may be formed substantially analogously to the sloping element. The further sloping element may be intended to cooperate indirectly or directly with the sloping element. The further sloping element may be intended to come into contact with the sloping element. The further sloping element may be mounted so as to be movable in a circumferential direction about the output axis and/or in an axial direction along the output axis relative to the sloping element. The further sloping element may be intended to be mounted so as to slide with respect to the sloping element.

The sloping element and the further sloping element may form a thread or a ramp.

The sloping element may be arranged on the clamping element. The sloping element may be formed in one piece with the clamping element. The further sloping element may be arranged on the further clamping element. The further sloping element may be formed in one piece with the further clamping element.

As a result, a desired clamping force can be set in a targeted manner.

It may be expedient when the clamping element is formed in one piece with the retaining element. The clamping element may be in the form of a separate clamping ring coupled to the retaining element. The clamping element may delimit the retaining element in a radial direction with respect to the output axis. The clamping element may be integrated with the retaining element. The clamping element may surround the retaining element in at least one plane through 360°. The clamping element may be arranged concentrically with the retaining element. The clamping element may be arranged on the retaining element. The clamping element may be in the form of a separate component which is able to be connected to the retaining element, in particular for conjoint rotation. The clamping element may be in the form of a separate component which is connected to the retaining element by a fastening means, for example a fastening screw. The clamping element may be in the form of a disk. The clamping element may be fixedly connected to the retaining element such that a relative movement (rotary movement, movement in translation) of the two elements is prevented. The clamping element may be connected to the retaining element for conjoint rotation. The clamping element may be intended to clamp the retaining element by means of a relative rotary movement of the clamping element with respect to a further element, for example a further clamping element, of the clamping unit. The clamping element may be arranged on a side of the retaining element that faces away from the accessory device. The clamping element may delimit an axial extent of the retaining element along the output axis. As a result, the clamping unit can be configured in a particularly compact manner.

It may furthermore be expedient when the quick clamping device, in particular the retaining unit, has a spindle element which is intended to cooperate with the retaining element, in particular by means of the clamping unit. The spindle element may be intended to drive the accessory device about the output axis. The spindle element may come into contact indirectly or directly with the accessory device. The spindle element may have a contact element, in particular a contact face, which serves as a support for the accessory device in an axial direction along the output axis. The spindle element may be in the form of a spindle sleeve. The spindle element may surround the retaining element in one plane through 360°. The spindle element may be intended to mount the accessory device for conjoint rotation, at least in a clamping state, in a circumferential direction about the output axis.

The spindle element may have the further clamping element assigned to the clamping element. The further clamping element may be formed in one piece with the spindle element. The further clamping element may be in the form of a thread element or of a ramp element. The further clamping element may delimit a radial extent of the spindle element.

The retaining unit, in particular the spindle element, may have a driving element which is intended to drive the accessory device or set it in rotation, in particular about the output axis. The driving element may be in the form of a rotary driving element. The driving element may be intended to grip the accessory device and/or to form a form fit with the accessory device.

Furthermore, it may be expedient when the quick clamping device has a cam mechanism which is intended to move the retaining unit, in particular the retaining element, in a direction of rotation about the output axis. The cam mechanism may be intended to move the retaining unit, in particular the retaining element, back and forth between two end positions. In particular, one of the two end positions can be a position that is fixable preferably by a securing unit. In particular, an advantageous force transmission and/or force conversion can be achieved. Advantageously, user-friendliness can be increased, in particular in that a simple operator maneuver, for example a push of a button and/or a lever adjustment can be converted into a more complex movement, for example a rotational movement, of the retaining element. In particular, the cam mechanism is intended to convert a linear movement, in particular of an unlocking bolt of the quick clamping device, at least partially into a rotational movement, in particular of the fixing element. An "end position" should be understood as meaning in particular a position in the open state and/or a position in the closed state. A "position that is fixable by the securing unit" should be understood as meaning in particular a position in the open state. Preferably, a "cam mechanism" is intended to convert a linear movement into a movement at least partially different than a linear movement, for example a rotational movement, or to convert a movement at least partially different than a linear movement into a linear movement.

Furthermore, it may be expedient when the cam mechanism has a guide unit which is intended to control a movement, in particular a rotary movement, of the retaining unit, in particular of the retaining element with respect to the spindle element. The guide unit has a guide cutout which is intended to guide a clamping pin, in particular axially along the output axis. The guide cutout can have a path curve having a course that is angled with respect to the output axis. The clamping pin may be guided in the guide cutout such that the clamping pin controls the clamping unit or the retaining unit. In particular, an advantageous force transmission and/or force conversion can be achieved. Advantageously, a movement of a component relative to the output unit can be forced by means of such a cam mechanism.

The guide unit can have a plurality of guide cutouts which have in particular a straight course, a helical course or a course curved in some other way.

The cam mechanism may have a plurality of cam mechanism elements. The cam mechanism elements may each have a guide cutout. The guide cutouts may be intended to guide a clamping pin. The guide cutouts may be intended to control a rotary movement of the retaining unit about the output axis. By means of the guide cutouts, a movement of the cam mechanism elements can be coupled.

In particular, an interaction of the guide unit and of the clamping unit has the effect that the retaining unit is controlled in particular from a releasing state to a clamping state, in particular from a retaining state to a clamping state.

It may be expedient when the clamping unit has a further sloping element, in particular in the form of a thread element or of a ramp element. The further sloping element may be spaced apart from the sloping element. The further sloping element may be in the form of a thread element.

The further sloping element may be arranged on the preloading element. The further sloping element may be formed in one piece with the preloading element. The further sloping element may surround the preloading element, in particular surround it in one plane of 360°.

It may be expedient when the quick clamping device has a preloading element which is intended to control a/the retaining parameter of the retaining unit. The preloading element is intended to cooperate with the retaining unit, in particular the retaining element and the spindle element. The preloading element may have a/the further clamping element. The preloading element may have a/the further sloping element, which is in particular in the form of a thread element or of a ramp element.

By means of the clamping element, particularly reliable and quick securing of the accessory device to the retaining unit can be ensured. In particular, the retaining parameter can be controlled particularly reliably by means of the cam mechanism and the clamping unit. In particular, a combination with the cam mechanism and the clamping unit results in adapted adjustability of the retaining unit.

It may be expedient when a movement of the retaining unit, in particular of the retaining element, in translation along the output axis from a transition from the retaining state into the clamping state and as far as the clamped-in-place state is greater than from the releasing state as far as the transition from the retaining state into the clamping state of the retaining unit. Preferably, a movement of the retaining unit in translation can be prevented between the releasing state and the clamping state and can be enabled in the clamping state. In this context, a movement should be understood as meaning in particular a movement of the retaining unit, in particular of the retaining element with respect to the spindle element. For a movement from a releasing state as far as the transition from the retaining state into the clamping state, the retaining element can merely be moved by means of a rotational movement such that the accessory tool is retained on the hand-held power tool. As a result, particularly reliable retention and clamping of the accessory device can be achieved.

Furthermore, it may be expedient when a rotational movement of the retaining element about the output axis from the releasing state as far as a transition from the retaining state into the clamping state is greater than a rotational movement from the transition from the retaining state into the clamping state and as far as a clamped-in-place state of the retaining unit. Preferably, a rotational movement of the retaining element can be prevented in the clamping state and can be enabled from the releasing state as far as the transition from the retaining state into the clamping state.

It may be expedient when the preloading element surrounds the retaining element, in particular surrounds it in a circumferential direction about the output axis. It may furthermore be expedient when the preloading element is substantially hollow-cylindrical. The preloading element may form a preloading sleeve. The preloading element may, in particular in a retaining state, be mounted so as to be movable with respect to the retaining element and/or the spindle element. The preloading element may be preloaded in an axial direction with respect to the retaining element. The preloading element may be arranged on the retaining element. The preloading element may be rotationally fixed with respect to the retaining element. The preloading element may be surrounded by the spindle element. The preloading element may be preloaded in a circumferential direction about the output axis with respect to the spindle element. The preloading element may have a main extent which extends along the output axis. By means of the preloading element, a retaining parameter of the retaining unit can be controlled in a particularly advantageous way. Furthermore, a separation of the functions can be achieved in that the preloading element transfers the retaining element, in particular by means of a rotary movement, from a releasing state into a retaining state, for the one part, and, in particular by means of a movement in translation, from a retaining state into a clamping state, for the other part.

It may be expedient when the retaining element has a spindle element and a retaining element, wherein the preloading element is arranged between the spindle element and the retaining element. The preloading element may surround the retaining element. The preloading element may be surrounded by the spindle element. The preloading element may be arranged concentrically with the spindle element and/or the retaining element. As a result, a particularly compact quick clamping device can be formed.

It may furthermore be expedient when the preloading element is coupled to the retaining element and the spindle element. The preloading element may be intended to cooperate with the spindle element and the retaining element. The preloading element may be intended to brace the retaining element in an axial direction along the output axis with respect to the spindle unit in a clamping state. Furthermore, it may be expedient when the quick clamping device has a clamping element which is intended to move the retaining unit, in particular the retaining element, axially along the output axis A. The clamping element may have a thread element or a ramp element. The preloading element may have a clamping element corresponding to the clamping element. The corresponding clamping element may be formed in one piece with the preloading element. The corresponding clamping element may be in the form of a thread element, in particular an internal thread, and/or of a ramp element. The corresponding clamping element may delimit the preloading element in a radial direction with respect to the output axis and/or in an axial along the output axis.

Furthermore, it may be expedient when the preloading element has a further clamping element, which is formed in one piece with the preloading element. The further clamping element may have a thread element, in particular an external thread, or a ramp element. The further clamping element may be coupled to the spindle element. The spindle element may have a further clamping element corresponding to the further clamping element. The corresponding further clamping element may be formed in one piece with the spindle element. The corresponding further clamping element may be in the form of a thread element, in particular of an internal thread. The corresponding further clamping element may delimit the spindle element in a radial direction with respect to the output axis and/or in an axial along the output axis. This allows particularly easy coupling of the retaining element and of the spindle element.

It is furthermore proposed that the quick clamping device have a spring element which is intended to preload the clamping unit, in particular the retaining element with respect to the preloading element and/or the spindle element. The spring element may be in the form of a tension/compression spring. The spring element may be in the form of a torsion spring. The spring element surrounds the retaining element in a plane through 360°. The spring element may be intended to transfer the hand-held power tool into a clamping state. In this way, restoration can be achieved particularly easily. As a result, a constant preloading force can be achieved.

The quick clamping device may have a spring element which is intended to preload the retaining element in a releasing state with respect to the preloading element and/or the spindle element. The spring element may be in the form of a tension/compression spring. The spring element may be mounted in a cavity of the retaining element. The spring element may be intended to preload the clamping pin or the unlocking bolt. The spring element may be preloaded to a greater extent in a releasing state than in a clamping state.

The quick clamping device may have a further spring element which is intended to preload the preloading element in a circumferential direction about the output axis with respect to the spindle element. The further spring element may be in the form of a torsion spring. The torsion spring may surround the retaining element in a plane through 360°. The further spring element may be intended to brace the preloading element in a clamping state with respect to the spindle element. The further spring element may be tensioned to a greater extent in the clamping state than in a releasing state. The torsion spring may be preloaded or relaxed with respect to the spindle element depending on a rotational movement of the retaining element.

The preloading element may be preloaded in an axial direction along the output unit or in a circumferential direction about the output axis by means of a spring element, in particular a torsion spring. It may furthermore be expedient when the preloading element is preloaded in a circumferential direction about the output axis by means of a spring element, in particular a torsion spring, in the releasing state and/or in a retaining state and/or in a clamping state.

The disclosure also relates to a hand-held power tool, in particular an angle grinder, having a quick clamping device for operating an accessory device.

BRIEF DESCRIPTION OF THE DRAWINGS

Further advantages will become apparent from the following description of the drawing. In the drawing, exemplary embodiments of the disclosure are illustrated. The drawings, the description and the claims contain numerous features in combination. A person skilled in the art will expediently also consider the features individually and combine them to form useful further combinations. In the drawing:

DETAILED DESCRIPTION

In the following figures, identical components are provided with the same reference signs.

Figure 1:
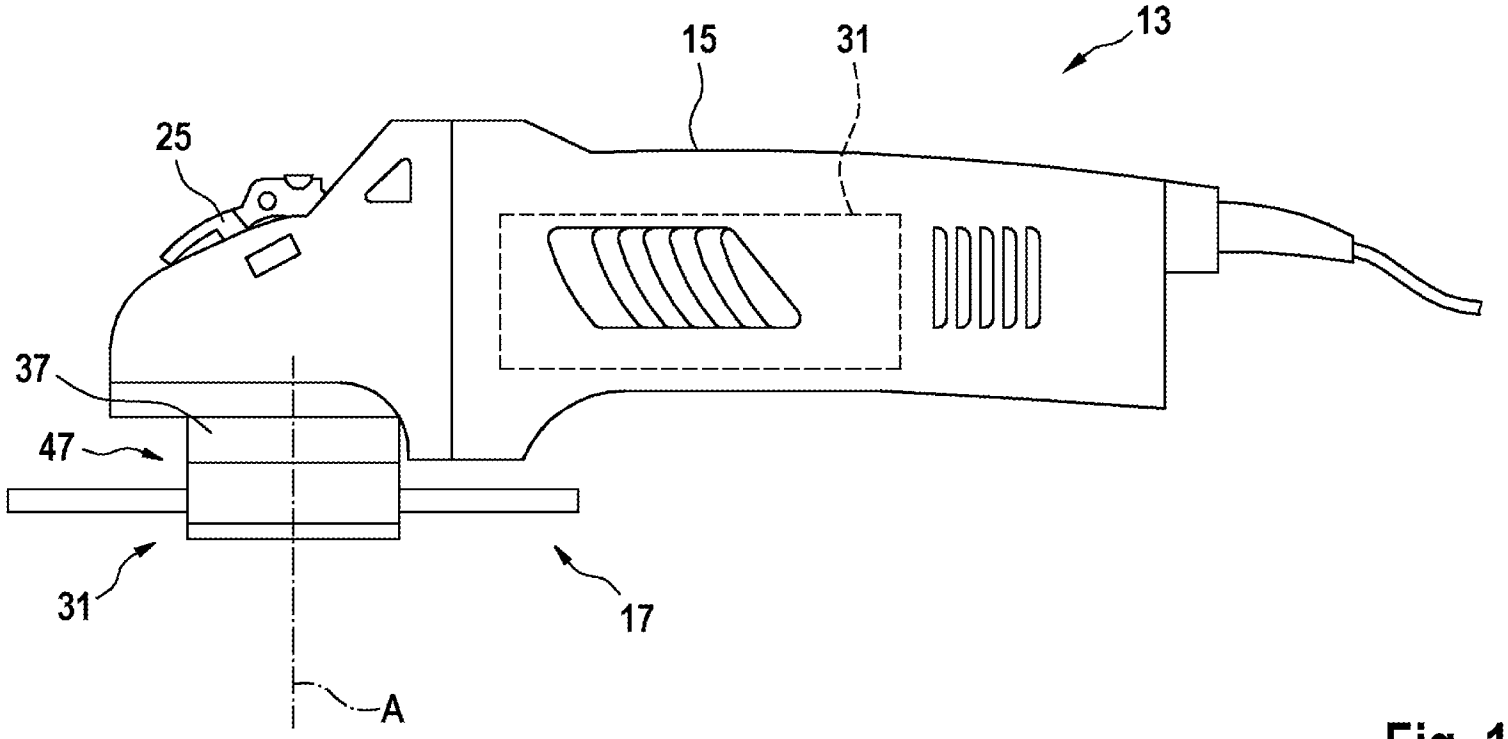
FIG. 1 shows a perspective view of a hand-held power tool with a quick clamping device according to the disclosure, FIGS. 2 and 3 each show a section through the hand-held power tool.
Figure 4:
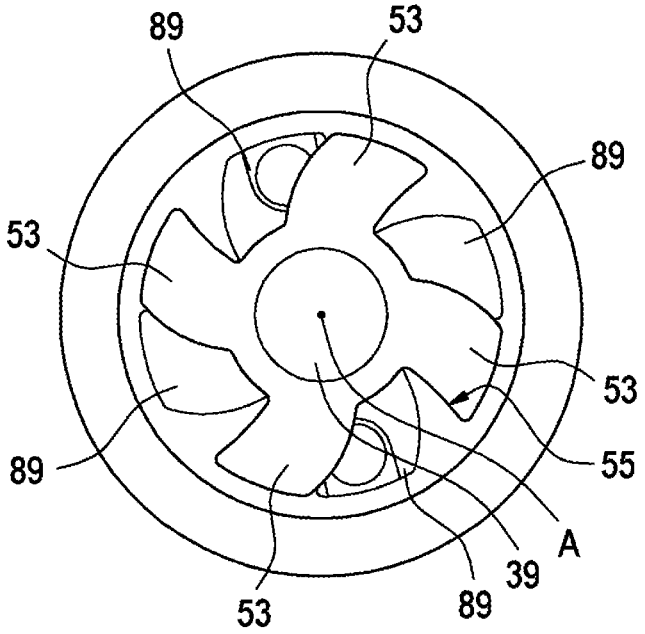
FIG. 4 shows two states of the quick clamping device.
Figure 4:
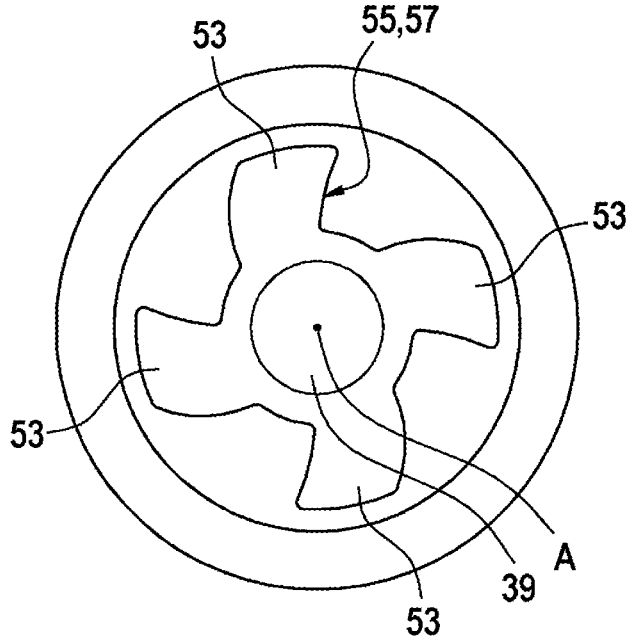
Figure 5:
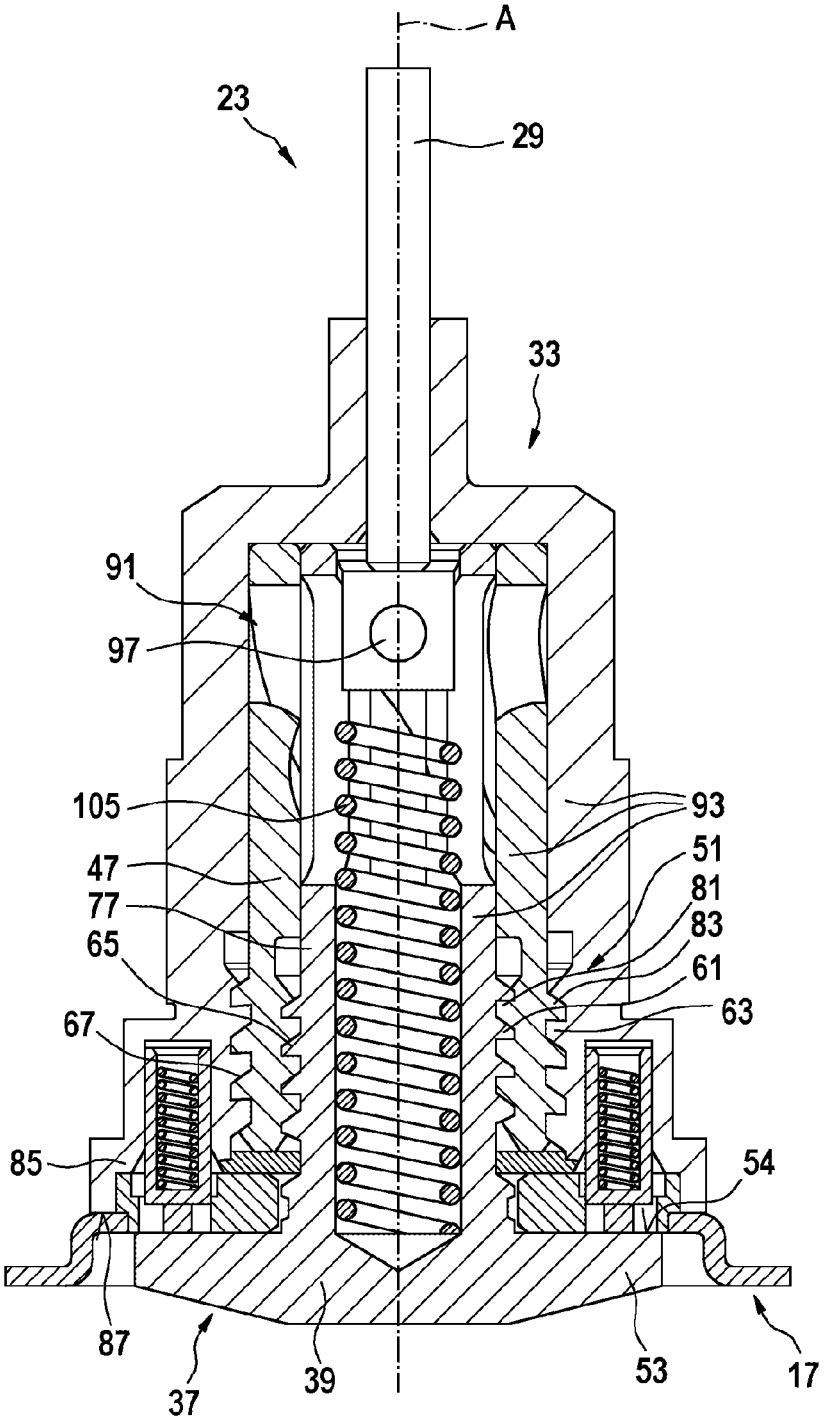
FIG. 5 shows a section through the quick clamping device.
Figure 6:
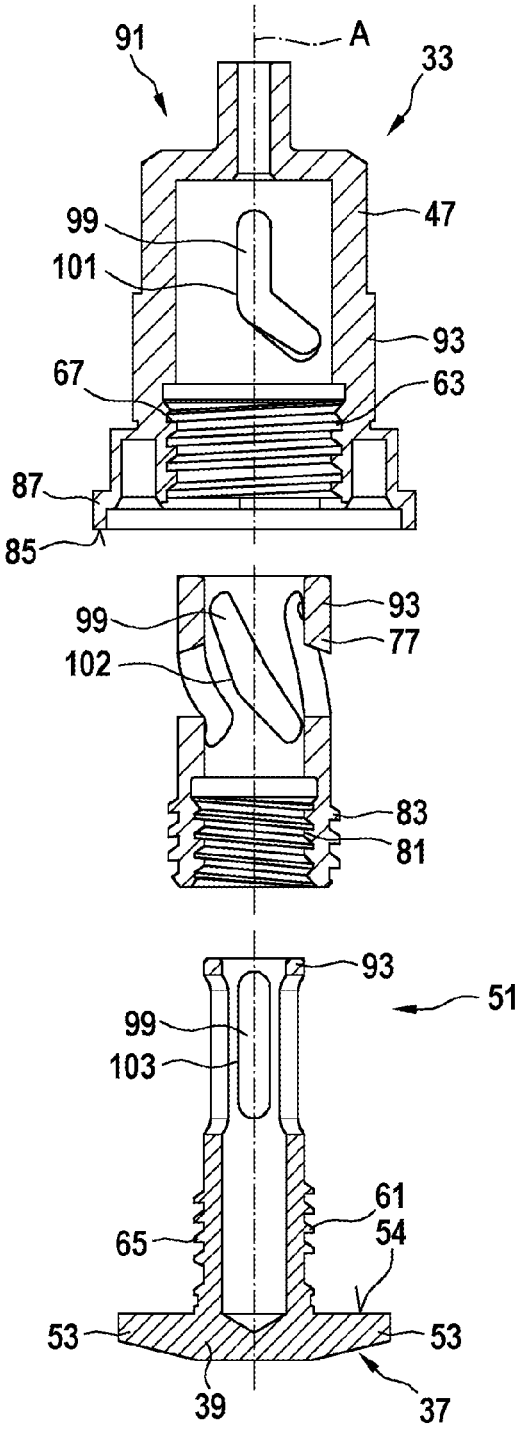
FIG. 6 shows an exploded view of the quick clamping device from FIG. 5, FIGS. 7 to 9 show a plurality of states of the quick clamping device.

FIG. 1 shows a power tool system having a hand-held power tool 13 with a housing 15 and an accessory device 17. The hand-held power tool 13 is in the form of an angle grinder. The accessory device 17 is in the form of a grinding wheel and/or of a cut-off wheel. The accessory device 17 has a connection device 19 (cf. FIG. 4). The connection device 19 is in the form of a continuous receiving cutout 21.

Figure 2:
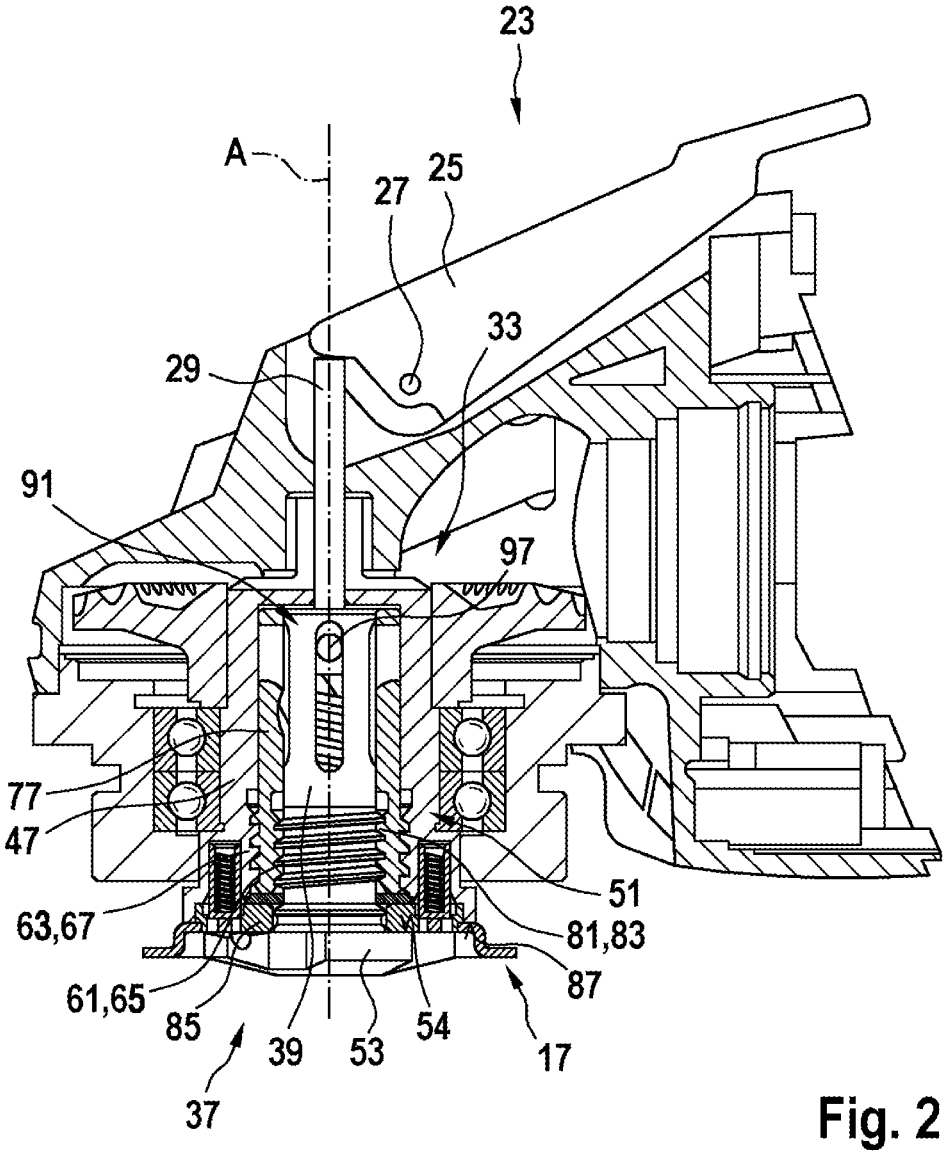
Figure 3:
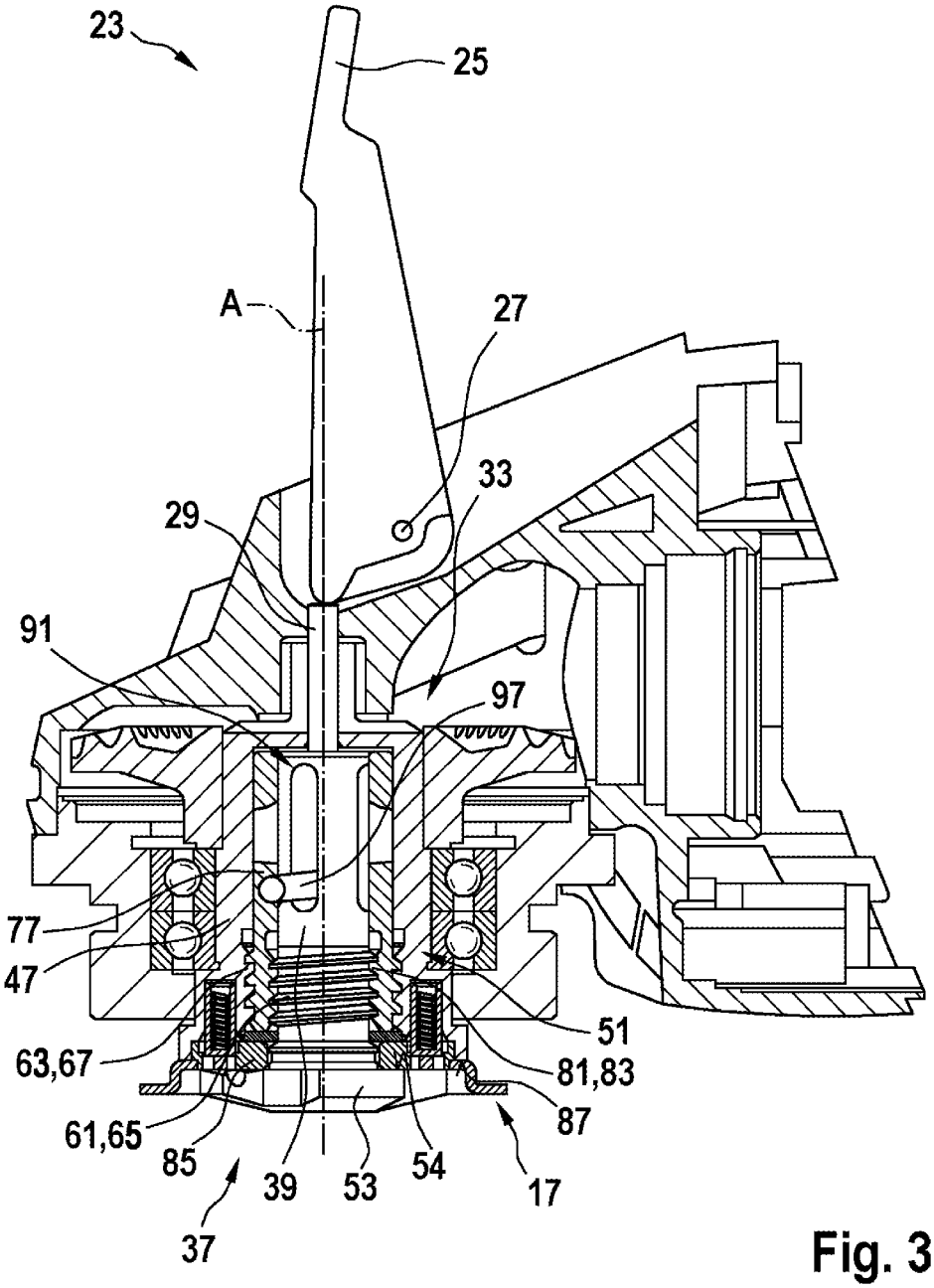

The hand-held power tool 13 has a quick clamping device 23, which is intended to arranged the accessory device 17 on the hand-held power tool 13. The hand-held power tool 13 has an actuation means 25 for opening and closing the quick clamping device 23. The actuation means 25 is in the form of a pull lever 54. The pull lever 54 has an eccentric 27. The actuation means 25 is intended, in particular by means of the eccentric 27, to move an unlocking bolt 29 (cf. FIGS. 2 and 3) of the quick clamping device 23 in an axial direction. The unlocking bolt 29 is intended to unlock the quick clamping device 23 when the unlocking bolt 29 moves into the housing 15 of the power tool 12. When the quick clamping device 23 is locked, the unlocking bolt 29 moves out of the housing 15 of the power tool 12. The actuation means 25 shown in FIG. 1 is in a closed state. The power tool 12 has a drive unit 31, which is intended to provide kinetic energy in order to move, in particular to rotate, the accessory device 17. The drive unit 31 is arranged in the housing 15. The drive unit 31 is in the form of an electric motor and embodied in particular as an EC motor.

The quick clamping device 23 has an output unit 33 for moving the accessory device 17 about an output axis A of the output unit 33. The drive unit 31 drives the output unit 33 in order to move the accessory device 17 about an output axis A. The output unit 33 is intended to transmit a rotational and/or oscillatory movement about the output axis A to an accessory device 17 retained on the output unit 33 by means of the retaining unit 37. The output unit 33 is operatively connected via a drive pinion of the drive unit 31. The output unit 33 comprises a spindle element 47 in the form of a hollow shaft, in particular of a hollow spindle.

The quick clamping device 23 also has a retaining unit 37, having a retaining element 39, for retaining the accessory device 17 on the hand-held power tool 13. The retaining unit 37 is settable such that a retaining parameter is changed in a retaining state, in particular during a transition from a retaining state into a clamping state, of the retaining unit 37.

Figure 10:
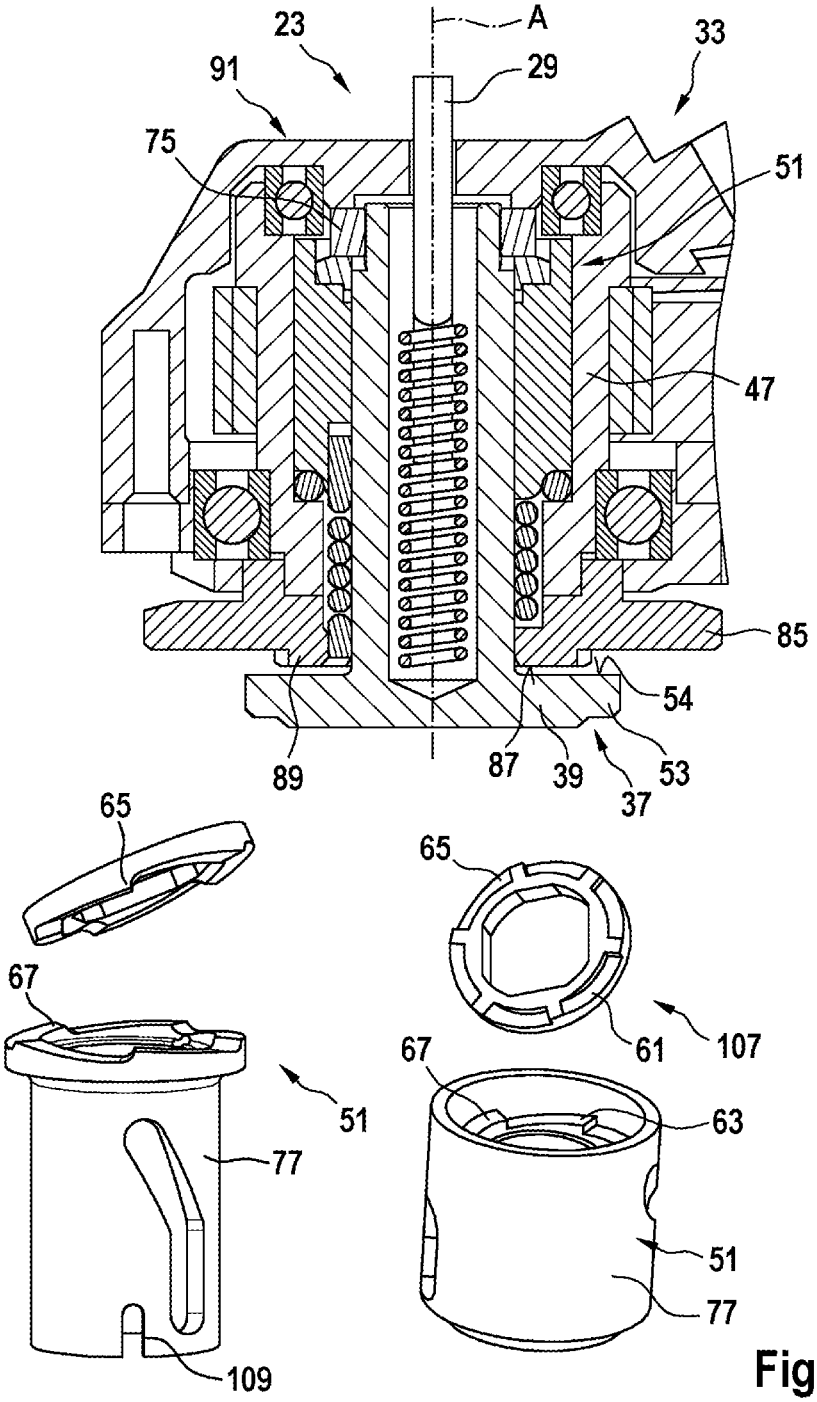
FIG. 10 shows a development of the quick clamping device.
Figure 11:
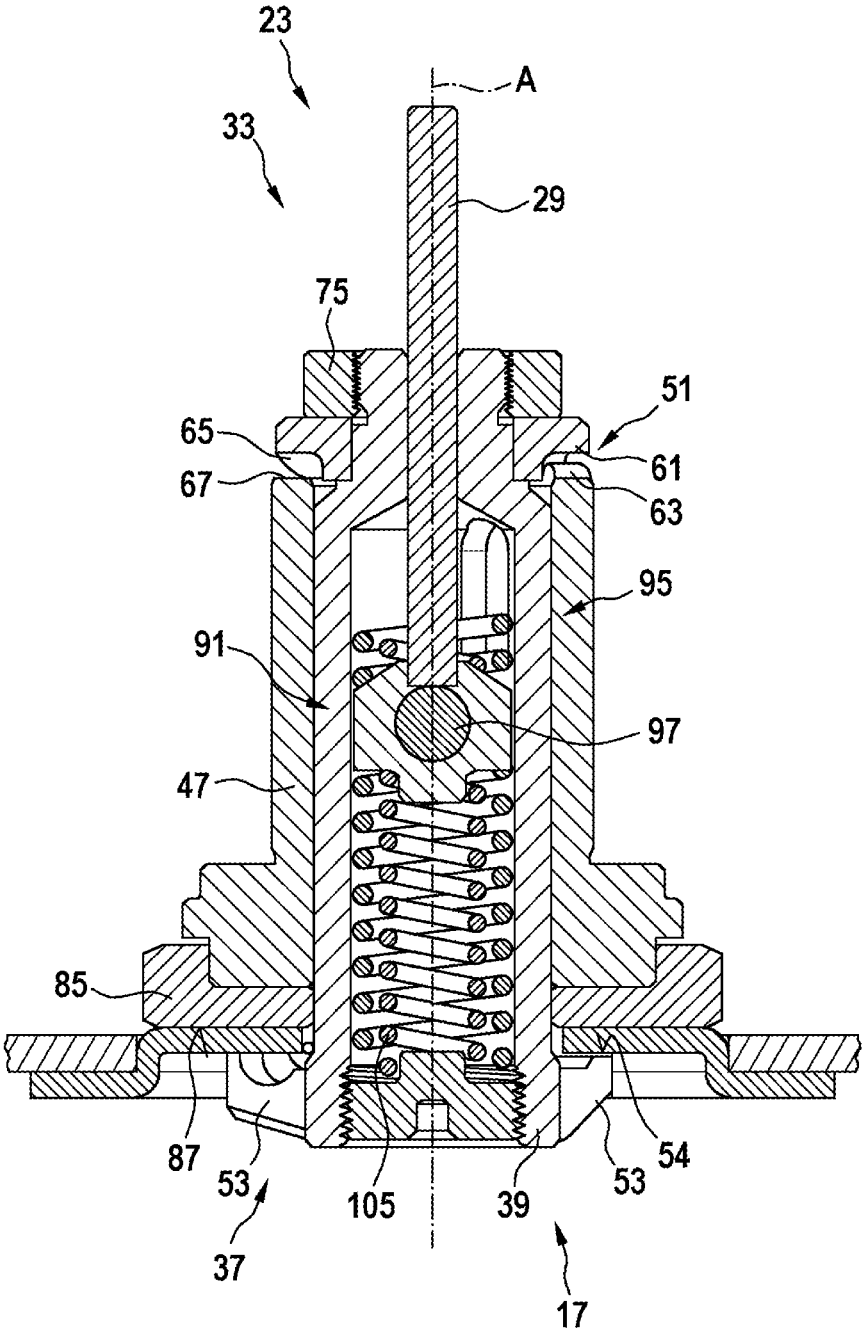
FIGS. 11 to 14 show a development of the quick clamping device.
Figure 12:
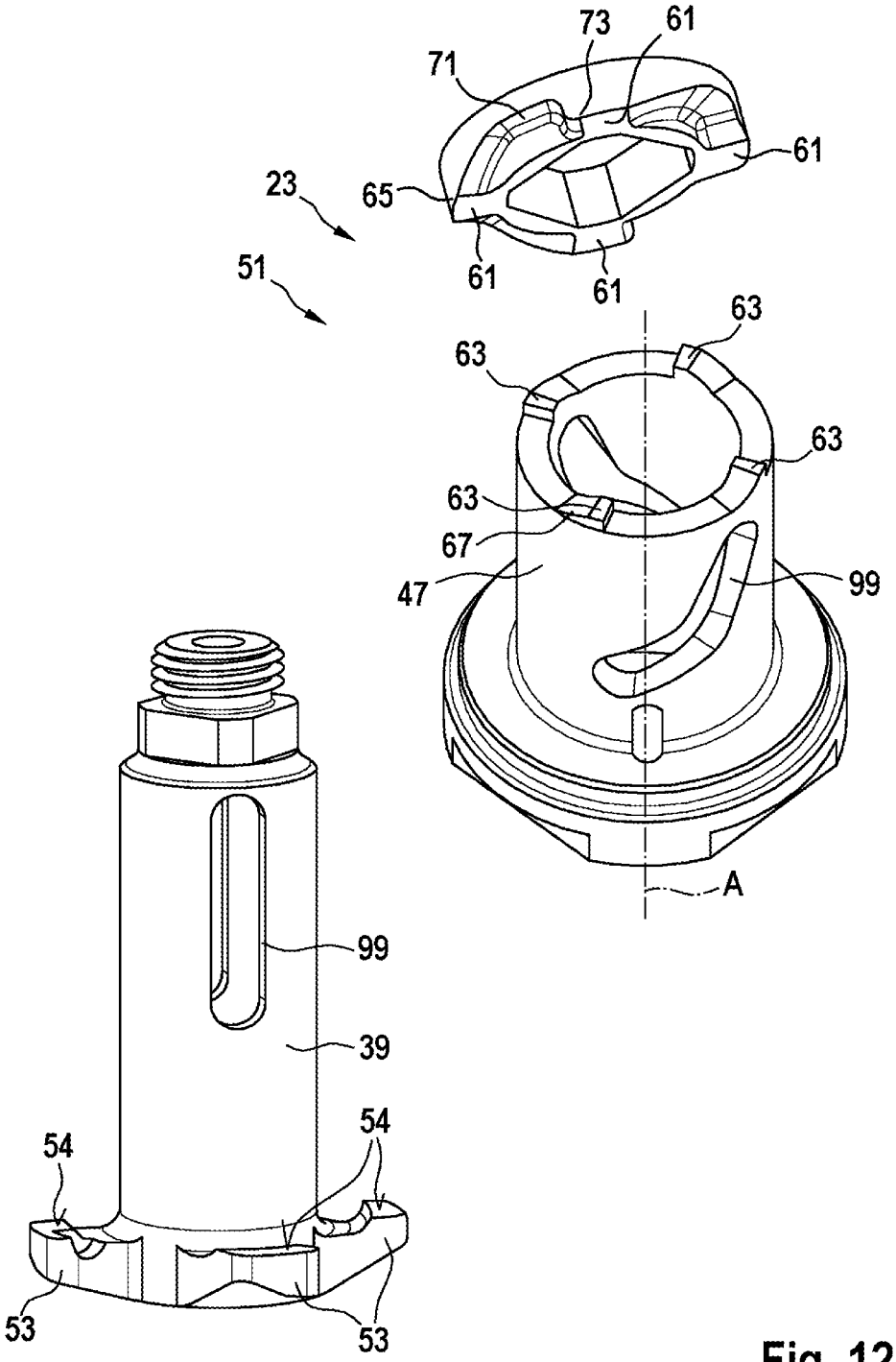

As a result of a change to the retaining parameter, the accessory device 17 can be transferred particularly easily from a retaining state into a clamping state. The retaining parameter of the retaining unit 37 is set such that the retaining unit 37 is transferred from a releasing state into a retaining state by means of a rotational movement (FIG. 10; FIG. 11 et seq.) or by means of a rotational movement and movement in translation (FIGS. 2 to 9), in order to retain the accessory device 17 on the quick clamping device 23. The retaining unit 37, or the retaining element 39, is in this case mounted, or forcibly actuated, so as to be movable in rotation (FIG. 10; FIG. 11 et seq.) or in rotation and translation (FIGS. 2 to 9) in a retaining state.

Figure 8:
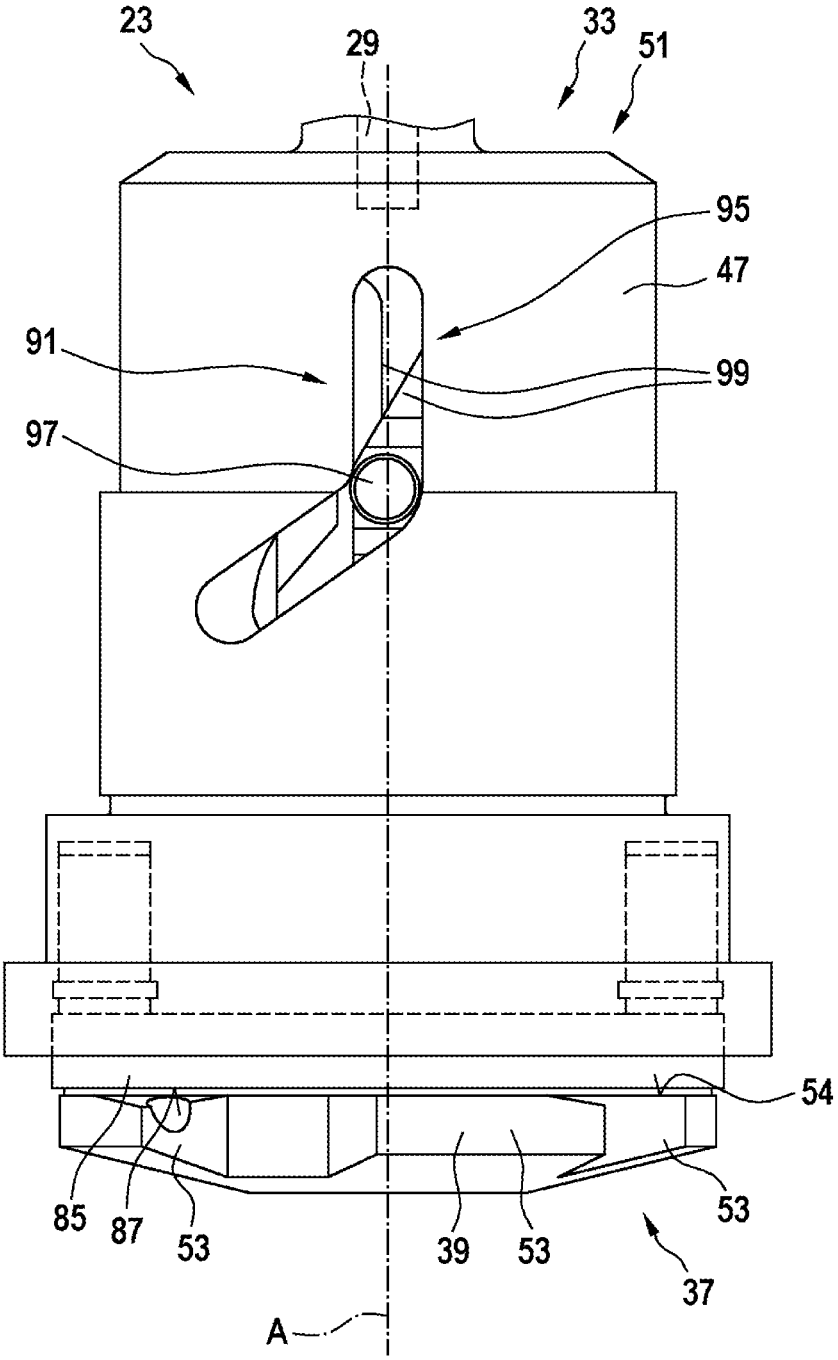
Figure 9:
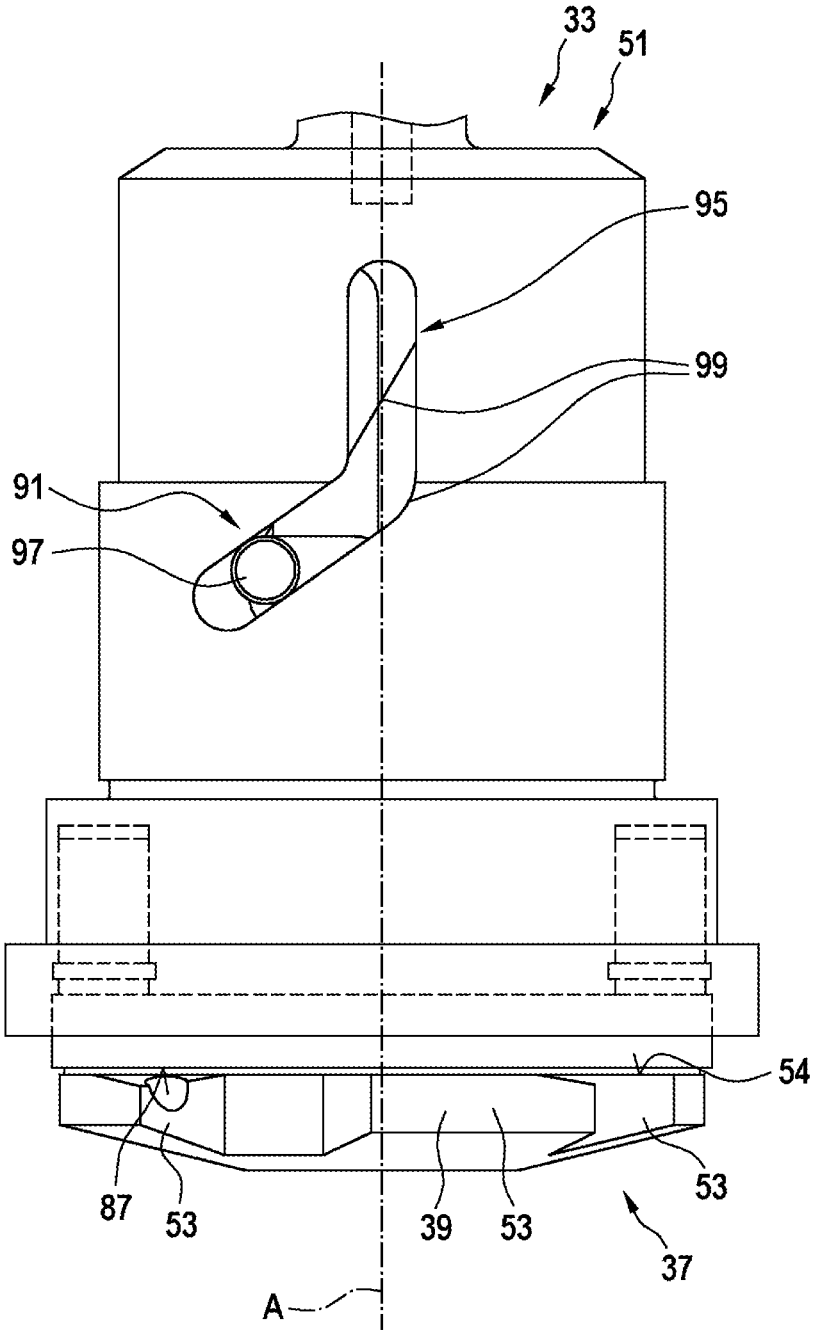

Furthermore, the retaining parameter of the retaining unit 37 is settable or variable such that the retaining unit 37 is transferred from a retaining state into a clamping state by means of a movement in translation, in order to clamp the accessory device 17 to the quick clamping device 23. The retaining unit 37, or the retaining element 39, is in this case mounted, or forcibly actuated, so as to be movable in translation (FIGS. 2 to 9; FIG. 10) or in rotation and translation (FIG. 11 et seq.) in a clamping state. Particularly advantageously, a separation of functions can be achieved as a result in that a retaining parameter of the retaining unit 37 is changed in a retaining state and so a direction of movement of the retaining element 39 of the retaining unit 37 can be changed, in particular prevented or enabled. For example, during a transition from a retaining state into a clamping state, a rotational relative movement about the output axis A and a relative movement in translation along the output axis A of the retaining element can be changed into a relative movement in translation along the output axis A (FIGS. 2 to 9). For example, during a transition from a retaining state into a clamping state, a rotational relative movement about the output axis A of the retaining element 39 can be changed into a relative movement in translation along the output axis A (FIG. 10). For example, during a transition from a retaining state into a clamping state, a rotational relative movement about the output axis A of the retaining element 39 can be changed into a rotational relative movement about the output axis A and a relative movement in translation along the output axis A (FIG. 11 et seq.).

A retaining parameter should be understood as meaning a degree of freedom of movement of the retaining element 39.

The retaining element 39 is intended to retain the accessory device 17 on the quick clamping device 23 by way of a form fit.

In addition to the retaining element 39, the retaining unit 37 has a spindle element 47. The retaining element 39 is mounted so as to be movable with respect to the spindle element 47 in one state. The retaining element 39 and the spindle element 47 are arranged with respect to one another such that the accessory device 17 is retained on the quick clamping device 23 in an axial direction along the output axis A. The retaining element 39 and the spindle element 47 are intended to transmit a clamping force to the accessory device 17 by means of a clamping unit 51. The clamping force corresponds preferably at least to a retaining force which is intended to retain the accessory device 17 on the quick clamping device 23 in an operating state of the quick clamping state 23 or of the hand-held power tool 13. The retaining element 39 and the spindle element 47 are mounted so as to be movable with respect to one another in an axial direction along the output axis A, in order to clamp the accessory device 17 in an axial direction.

The spindle element 47 engages around the retaining element 39 along a circumferential direction which lies in a plane, the surface normal of which extends at least substantially parallel to the output axis A. The spindle element 47 is in the form of a hollow shaft, in order to at least partially receive the retaining element 39.

Figure 13:
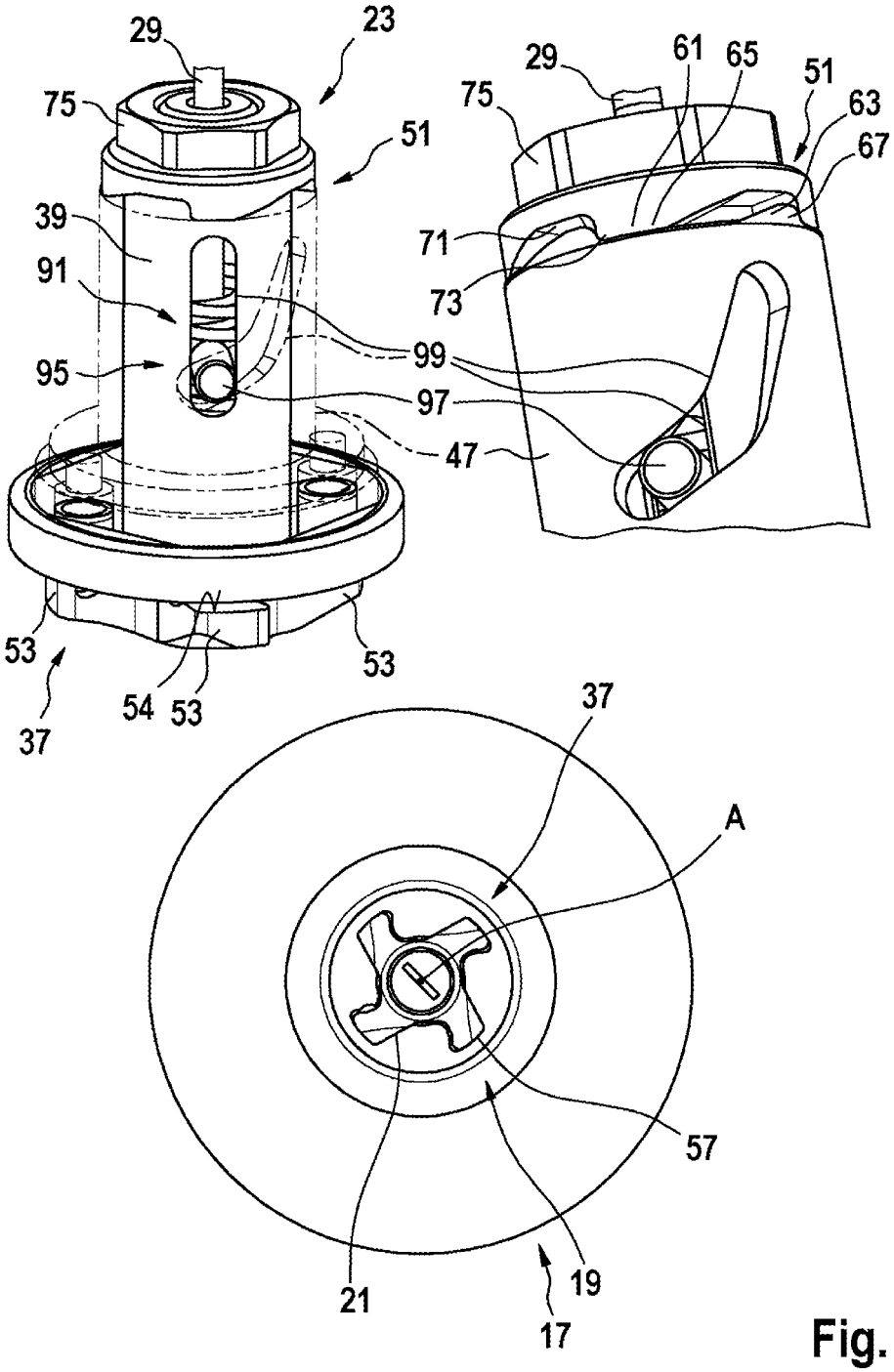

The retaining element 39 is intended to engage through a receiving cutout 21 of the accessory device 17 and to retain the accessory device 17 on the quick clamping device 23 by way of a form fit. The retaining element 39 has a plurality of, in particular four, retaining wings 53, which extend outwardly in a radial direction with respect to the output axis A. The retaining element 39 has a retaining contour 55, which corresponds approximately to a receiving contour 57 of a receiving cutout 21 of the accessory device 17. The retaining contour 55 is outlined by contours of the retaining wings 53. The retaining contour 55 is formed approximately so as to correspond to the receiving contour and so as to be smaller than the receiving contour 57, in order to allow the retaining wings 53 to engage through the receiving cutout 21. The retaining element 39 is configured such that the retaining contour 55 fits through the receiving contour 57 in order for it to be possible to plug the retaining element 39 through the receiving cutout 21 of the accessory device 17. To this end, the retaining element 39 is intended to engage through the receiving cutout 21 of the accessory device 17 by means of the retaining wings 53 and to retain the accessory device 17. The retaining element 39 is rotatable with respect to the receiving cutout 21 such that the retaining wings 53 form a form fit with the accessory device 17. The retaining contour 55 is able to oriented with respect to the receiving contour 57 such that, in a first rotary position (FIG. 13), the retaining contour 55 covers the receiving contour 57 such that the retaining element 39 is able to be plugged through the receiving cutout 21, and upon rotation about the output axis A into a second rotary position (FIG. 14), the retaining contour 55 overlaps the receiving contour 57 of the receiving cutout 21. The retaining element 39 is able to be plugged through the accessory tool depending on a rotary position of the retaining element 39 and, in the event of a change in the rotary position, forms a form fit, in particular in an axial direction along the output axis A, with the accessory device 17.

Figure 7:
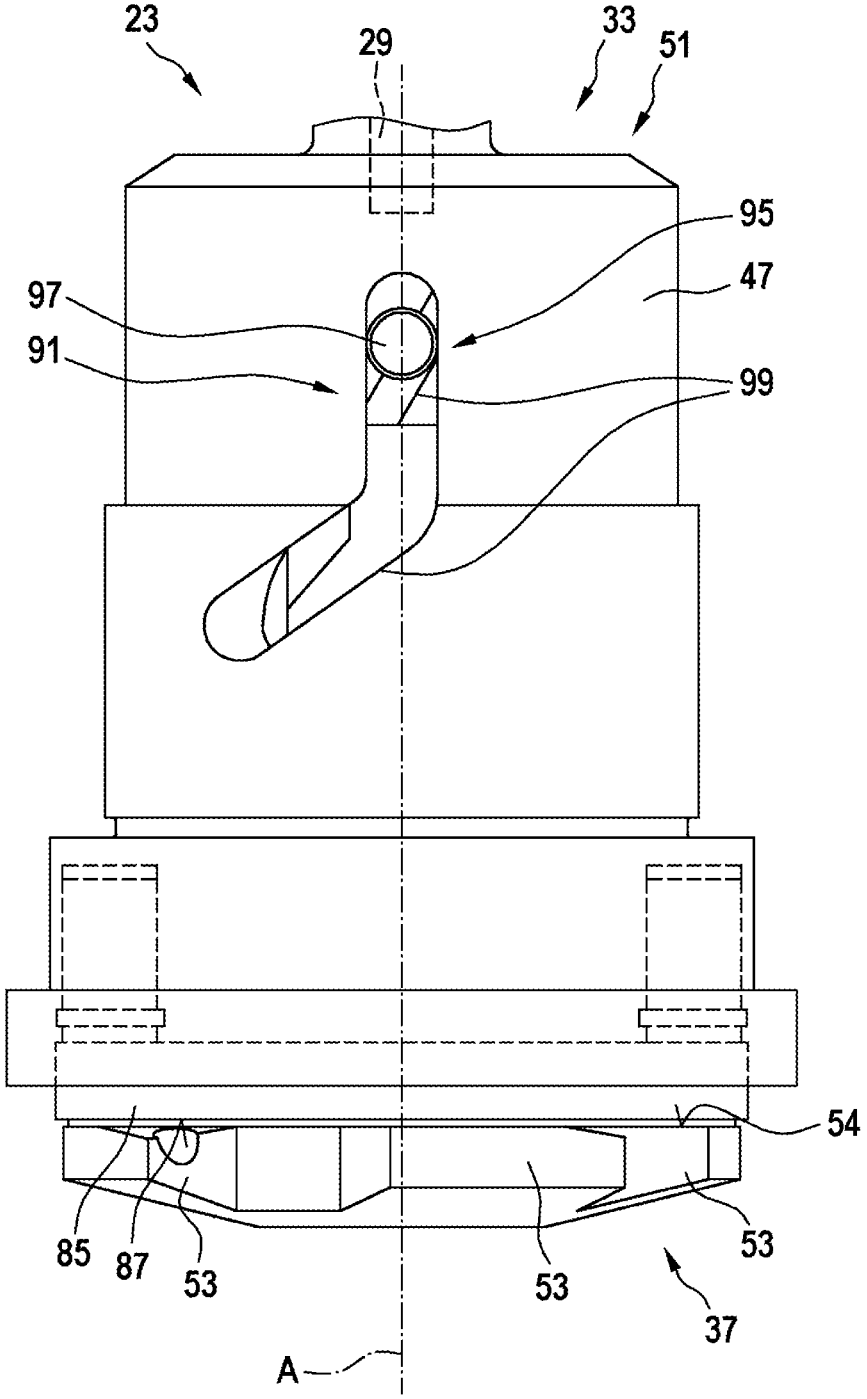

The retaining element 39 is connected to the quick clamping device 23, in particular so as to be unable to be removed, in a releasing state (FIG. 9), a retaining state (FIG. 8) and a clamping state, in particular a clamped-in-place state, (FIG. 7). The retaining element 39 is mounted so as to be movable in translation in an axial direction along the output axis A and/or in rotation about the output axis A in relation to the spindle element 47, wherein an axis of movement, in particular an axis of rotation, of the retaining element 39 coincides at least substantially with the output axis A. In FIG. 9, the quick clamping device is in a releasing state and passes into a retaining state upon movement of the retaining element 39. The releasing state in FIG. 9 forms a bottom dead center of the retaining element. When the quick clamping device moves from a position in FIG. 9 to a position in FIG. 8, the quick clamping device is in a retaining state. In FIG. 8, the quick clamping device is transitioning from a retaining state into a clamping state. When the quick clamping device moves from a position in FIG. 8 to a position in FIG. 7, the quick clamping device is in a clamping state and, in FIG. 7, reaches a clamped-in-place state, in which the retaining element reaches a top dead center.

The retaining element 39 is mounted so as to be rotatable substantially about the output axis A in the retaining state and/or mounted so as to be movable substantially along the output axis A in a/the clamping state. In the retaining state, the retaining element 39 is mounted so as to be rotatable about the output axis A and/or to be movable along the output axis A. In the clamping state, the retaining element 39 is mounted so as to be rotatable about the output axis A and/or to be movable along the output axis A. The retaining element 39 may be mounted so as not to be movable along the output axis A in the retaining state (FIG. 10; FIG. 11 et seq.). The retaining element 39 may be mounted so as not to be rotatable about the output axis A in the clamping state (FIGS. 2 to 9; FIG. 10). Separation of the functions can be achieved in that the retaining element 39, during a transition from the retaining state into the clamping state, is switched from being mounted so as to be rotatable about the output axis A to being mounted so as to be movable along the output axis A. Separation of the functions can also be achieved in that the retaining unit 37 is mounted, for example in a clamping state, so as to be movable in translation along the output axis A or mounted so as to be movable in translation along the output axis A and to be rotatable about the output axis A.

In FIG. 10 and FIG. 11 et seq., a movement of the retaining element with respect to the spindle element along the output axis from the releasing state as far as a transition from the retaining state into the clamping state of the retaining unit is prevented. In FIGS. 2 to 9, a movement of the retaining element with respect to the spindle element about the output axis from a transition from the retaining state into the clamping state as far as a clamped-in-place state of the retaining unit is prevented.

To fix the accessory device, the retaining element is rotatable through an angle about the output axis with respect to the spindle element from a releasing state (bottom dead center) as far as a clamped-in-place state (top dead center). The angle may comprise a range from 0° to 40° with a tolerance of +20° to −10° (FIGS. 2 to 9; FIG. 10). The angle may comprise a range from 0° to 48° with a tolerance of +/−16° (FIG. 11 et seq.).

A change in the retaining parameter can take place by changing a degree of freedom of the retaining unit 37, in particular of the retaining element 39, in that, for example, a rotational movement is prevented and a movement in translation is enabled.

Figure 14:
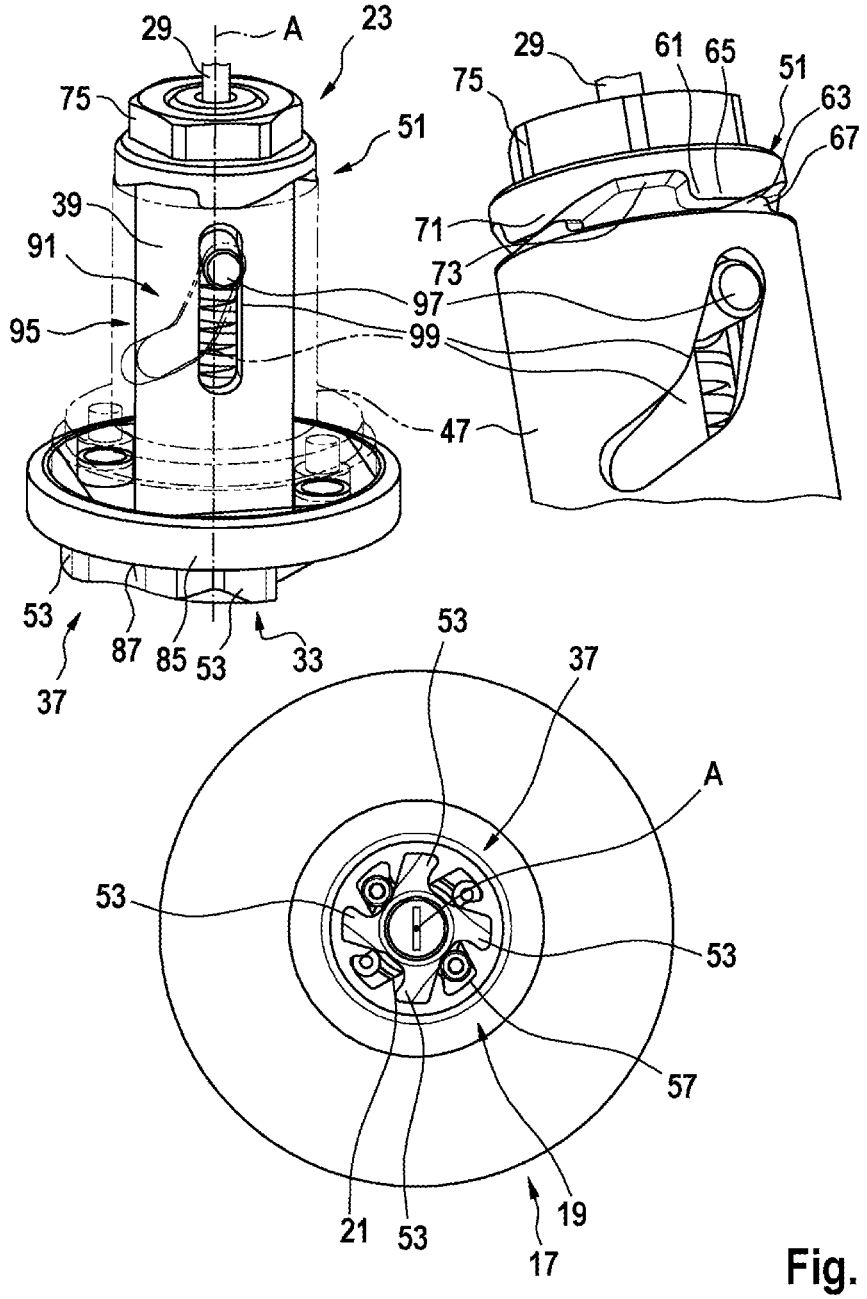

The retaining element 39 is intended to engage through the accessory device 17 and to clamp the accessory device 17. The retaining element 39 is intended to extend through the accessory device 17 in a releasing state and to rotate about the output axis A with respect to the accessory device 17 by means of a rotary movement in a retaining state, in order to hold the accessory device 17 by way of a form fit. Depending on a rotary position of the retaining element 39, the retaining element 39 is able to be plugged through the accessory tool (FIG. 13) and, in the event of a change in the rotary position, forms a form fit in an axial direction along the output axis A with the accessory device 17 (FIG. 14). The retaining element 39 has a retaining wing 53 which extends in a radial direction with respect to an output axis A and is intended to engage at least partially around the accessory device 17. The retaining wing 53 is intended to exert a clamping force on the accessory device 17. The retaining wing 53 has a retaining face 54 which extends in a radial direction with respect to the output axis A in a radial plane of the output axis A.

The retaining element 39 is intended to transfer the accessory device 17 from a releasing state into a retaining state (FIGS. 2 to 9; FIG. 10) and/or a clamping state (FIG. 11 et seq.) by means of a rotary movement of the retaining element 39 about the output axis A with respect to the spindle element 47.

The quick clamping device 23 has a clamping unit 51, having a clamping element 61, which is intended to move the retaining element 39 axially along the output axis A. The clamping unit 51 is coupled to the retaining unit 37. The clamping element 61 is intended to transfer the accessory device 17 from a retaining state into a clamping state in an axial direction by means of the retaining unit 37. The clamping element 61 is intended to transmit a clamping force axially along the output axis A to the accessory device 17 in order to brace the accessory device 17. The clamping element 61 is intended to control an axial movement of the retaining element 39. The clamping element 61 is intended to brace the accessory device 17 in an axial direction along the output axis A by means of a relative movement or a rotary movement of the clamping element 61 about the output axis A with respect to the spindle element 47.

The clamping element 61 has a sloping element 65 in the form of a thread element (FIGS. 2 to 9) or of a ramp element (FIG. 10; FIG. 11 et seq.). The sloping element 65 is configured in the manner of a wedge element which is intended to convert a movement of the retaining element 39 in the circumferential direction about the output axis A into a movement of the retaining element 39 in an axial direction along the output axis A. The sloping element 65 may have a varying or constant slope. The sloping element may be configured with a monotonic, in particular strictly monotonic slope. The sloping element 65 may form a threaded portion.

The clamping unit 51 has a plurality of sloping elements 65, which follow one another in a circumferential direction. The sloping elements 65 may be arranged in series with one another in a circumferential direction (FIG. 10). The sloping elements 65 may be spaced apart from one another in a circumferential direction (FIG. 11 et seq.). The sloping elements 65 are delimited by two radial planes, which extend radially with respect to the output axis A and/or are arranged parallel to one another. The two radial planes delimit each first sloping element 65. A spacing of the two radial planes is delimited by a maximum axial extent of the sloping elements 65. The two radial planes may be at a spacing from one another, which corresponds substantially to a maximum axial movement of the retaining element 39 along the output axis A from a releasing state into a clamping state.

The sloping element 65 has a first sloping portion 71 and a second sloping portion 73 that is angled with respect to the first sloping portion 71. The first sloping portion 71 extends in a radial plane of the output axis A. The first sloping portion 71 is formed in a planar manner. The first sloping portion 71 is embodied so as to be flat in a circumferential direction about the output axis A and does not have a slope. It is conceivable for the first sloping portion 71 to be angled with respect to a radial plane of the output axis A. The second sloping portion 73 is angled with respect to a radial plane of the output axis A. By means of the first sloping portion 71 and the second sloping portion 73 of the sloping element 65, the retaining parameter of the retaining unit 37 can be changed.

The further sloping element 67 may be configured analogously to the sloping element 65.

The clamping unit 51 has a further sloping element 67 which is assigned to the sloping element 65 and is intended to cooperate indirectly or directly with the sloping element 65. The further sloping element 67 comes into contact with the sloping element 65. The further sloping element 67 is mounted so as to be movable in a circumferential direction about the output axis A and/or in an axial direction along the output axis A relative to the sloping element 65. The further sloping element 67 is mounted so as to slide with respect to the sloping element 65. The sloping element 65 and the further sloping element 67 may each form a thread element (FIGS. 2 to 9) or a ramp element (FIG. 10; FIG. 11 et seq.) which cooperate with one another. The further sloping element 67 is arranged on a further clamping element 63.

The clamping element 61 may be formed in one piece with the retaining element 39 (FIGS. 2 to 9). The clamping element 61 may be configured as a separate clamping ring coupled to the retaining element 39 (FIG. 10; FIG. 11 et seq.).

The clamping element 61 delimits the retaining element 39 in a radial direction with respect to the output axis A. The clamping element 61 is integrated with the retaining element 39. The clamping element 61 surrounds the retaining element 39 in at least one plane through 360° and is arranged concentrically with the retaining element 39. The clamping element 61 is in the form of a separate component which is able to be connected to the retaining element 39 for conjoint rotation (FIG. 10; FIG. 11 et seq.). The clamping element 61 is in the form of a separate component which is connected to the retaining element 39 by a fastening means 75 in the form of a fastening screw. The clamping element 61 is substantially in the form of a disk. The clamping element 61 is substantially annular. The clamping element 61 is connected fixedly to the retaining element 39 such that a relative movement (rotary movement, movement in translation) of the two elements is prevented. The clamping element 61 is connected to the retaining element 39 for conjoint rotation. The clamping element 61 is intended to clamp the retaining unit 37 by means of a rotary movement of the clamping element 61 with respect to a further clamping element 61, 63 of the clamping unit 51. The clamping element 61 is arranged on a side of the retaining element 39 that faces away from the accessory device 17. The clamping element 61 is placed on the retaining element 39.

The clamping unit 51 has a further clamping element 63, which is intended to cooperate indirectly or directly with the clamping element 61. The further clamping element 63 may be formed on the spindle element 47 or on a preloading element 77.

In FIGS. 2 to 9, the further clamping element 63 is arranged on the spindle element 47 and intended to cooperate with the clamping element 61, formed in one piece with the retaining element 39, indirectly or by means of a preloading element 77 in the form of a preloading sleeve. The clamping element 61 is formed integrally with the retaining element 39. The further clamping element 63 delimits a radial extent of the spindle element 47. The further clamping element 63 is formed in one piece or integrally with the retaining element 39. In this case, the preloading element 77 has two intermediate clamping elements 81, 83 that correspond to the clamping element 61 and the further clamping element 63. The intermediate clamping elements 81, 83 are arranged on the preloading element 77 and formed in one piece therewith. A first intermediate clamping element 81 is arranged on an inner side of the preloading element 77 and is in the form of an internal thread. A second intermediate clamping element 83 is arranged on an outer side of the preloading element 77 and is in the form of an external thread. The first intermediate clamping element 81 is intended to cooperate with the clamping element 61 in the form of an external thread. The second intermediate clamping element 83 is intended to cooperate with the further clamping element 63, in the form of an internal thread, of the spindle element 47. The intermediate clamping elements 81, 83 delimit the preloading element 77 in a radial direction with respect to the output axis A. The further clamping element 63 is formed in one piece with the preloading element 77.

In FIG. 10, the further clamping element 63 is arranged on a preloading element 77 in the form of a preloading sleeve, and is intended to cooperate directly with the clamping element 61 in the form of a clamping ring. The clamping element 61 is in the form of a separate component. The clamping element 61 is in the form of a separate clamping ring coupled to the retaining element 39. The clamping element 61 and the further clamping element 63 are in the form of ramp elements (FIG. 10; FIG. 11 et seq.). The further clamping element 63 delimits the preloading element 77 in an axial direction along the output axis A. The further clamping element 63 is formed in one piece with the preloading element 77. Depicted at the bottom left in FIG. 10 is a development of the preloading element 77, which has a further clamping element 63 which delimits an axial extent of the preloading element 77. The further clamping element 63 extends in this case annularly on an end face of the preloading element 77 and/or protrudes radially with respect to the output axis A. At the bottom left in FIG. 10, the further clamping element 63 is arranged in an inner region of the preloading element 77. The further clamping element 63 is delimited in a radial direction by a hollow-cylindrical wall extending in an axial direction along the output axis A.

In FIG. 11 et seq., the further clamping element 63 is arranged on the spindle element 47 in the form of a spindle sleeve and is intended to cooperate directly with the clamping element 61 in the form of a clamping ring. The further clamping element 63 delimits the spindle element 47 in an axial direction along the output axis A. The further clamping element 63 is formed in one piece with the spindle element 47. The further clamping element 63 is coupled to the clamping element 61 and comes into direct contact therewith.

The clamping element 61 and the further clamping element 63 each have at least one sloping element 65, 67, which forms the thread element or the ramp element. It goes without saying that it is also possible for only the clamping element 61 or the further clamping element 63 to have a sloping element 65, 67. For example, it is possible for one of the clamping elements 61, 63 not to have a sloping element 65, 67 but to be formed for example as a kind of elevation which is intended to cooperate with sloping element 65, 67 corresponding to the elevation.

The retaining element 39 has a spindle element 47, which is intended to cooperate with the retaining element 39 by means of the clamping unit 51 and to drive the accessory device 17 about the output axis A. The spindle element 47 comes into indirect contact with the accessory device 17 in that the spindle element 47 has a contact element 85 having a contact face 87, said contact element 85 serving as a support for the accessory device 17 in an axial direction along the output axis A. The spindle element 47 is in the form of a spindle sleeve and surrounds the retaining element in a plane through 360°. The spindle element 47 is intended to mount the accessory device 17 for conjoint rotation in a circumferential direction about the output axis A, at least in a clamping state, and to drive it in an operating state. To this end, the spindle element 47 has a driving element 89 which is intended to set the accessory device 17 in rotation about the output axis A. The driving element 89 is in the form of a rotary driving element. The driving element 89 is intended to engage through the accessory device 17 and/or to form a form fit with the accessory device 17.

The quick clamping device 23 has a preloading element 77, which is intended to control a/the retaining parameter of the retaining unit 37. The preloading element 77 is intended to cooperate with the retaining element 39 and the spindle element 47. The preloading element 77 has the further clamping element 61, 63 with a further sloping element 65, 67, which is in the form of a thread element or an external thread.

In particular, a movement of the retaining element 39 in translation with respect to the spindle element along the output axis A from a transition from the retaining state into the clamping state as far as the clamped-in-place state (top dead center) is greater than from the releasing state as far as the transition from the retaining state into the clamping state of the retaining element 39. Preferably, a movement of the retaining element 39 in translation between the releasing state and the transition from the retaining state into the clamping state is prevented and from the transition from the retaining state into the clamping state or the clamped-in-place state is enabled. In order to move from a releasing state as far as the transition from the retaining state into the clamping state, the retaining element 39 may be movable only by means of a rotational movement such that the accessory device is retained on the hand-held power tool 13.

In particular, a rotational movement of the retaining element 39 with respect to the spindle element about the output axis A from the releasing state as far as a transition from the retaining state into the clamping state is greater than a rotational movement from the transition from the retaining state into the clamping state as far as a clamped-in-place state of the retaining element 39. Preferably, a rotational movement of the retaining element 39 from the transition from the retaining state into the clamping state is prevented and from the releasing state as far as the transition from the retaining state into the clamping state is enabled.

The preloading element 77 surrounds the retaining element 39 in a circumferential direction about the output axis A. The preloading element 77 is substantially hollow-cylindrical and forms a preloading sleeve. The preloading element 77 is mounted so as to be movable with respect to the retaining element 39 and/or the spindle element 47 in a retaining state and is preloaded in an axial direction with respect to the retaining element 39. The preloading element 77 is arranged on the retaining element 39 and coupled thereto. The preloading element 77 is formed so as to be rotationally fixed with respect to the retaining element 39 and is surrounded by the spindle element 47. The preloading element 77 is preloaded in a circumferential direction about the output axis A with respect to the spindle element 47 and has a main extent which extends along the output axis A. By means of the preloading element 77, separation of the functions can be achieved in that the preloading element 77 transfers the retaining element 39 by means of a rotary movement from a releasing state into a retaining state, for the one part, and by means of a movement in translation from a retaining state into a clamping state, for the other part.

The retaining unit 37 has a spindle element 47 and a retaining element 39, wherein the preloading element 77 is arranged between the spindle element 47 and the retaining element 39. The preloading element 77 encases the retaining element 39 and is encased by the spindle element 47. The preloading element 77 is arranged concentrically with the spindle element 47 and the retaining element 39.

The preloading element 77 is coupled to the retaining element 39 and to the spindle element 47 and is intended to cooperate with the spindle element 47 and the retaining element 39. To this end, the preloading element 77 is intended to brace the retaining element 37 in an axial direction along the output axis A with respect to the spindle unit in a clamping state.

The quick clamping device 23 has a cam mechanism 91 which is intended to move the retaining element 39 in a direction of rotation about the output axis A. The cam mechanism 91 is intended to move the retaining element 39 back and forth between two end positions (FIGS. 7 to 9). The cam mechanism 91 is intended to convert a linear movement of the unlocking bolt 29 of the quick clamping device 23 at least partially into a rotational movement, in particular of the retaining element 39. To this end, the cam mechanism 91 has a guide unit 95, which is intended to control a rotary movement of the retaining element 39 with respect to the spindle element 47. The guide unit 95 is intended to transfer the retaining element 39 from a releasing state into a clamping state and vice versa. The guide unit 95 has a plurality of guide cutouts 99, which are intended to guide a clamping pin 97 connected transversely to the unlocking bolt 29 axially along the output axis A. The unlocking bolt 29 is connected to the clamping pin 97 by way of a form fit. The unlocking bolt 29 is arranged coaxially with the output axis A. The clamping pin 97 is in the form of a clamping bolt and intended to delimit a movement of the retaining element 39 in an axial direction along the output axis A and/or in a circumferential direction about the output axis A with respect to the spindle element 47. The guide cutouts 99 partially have a path curve having a course that is angled with respect to the output axis A. The clamping pin 97 is guided in the guide cutout 99 such that the clamping pin 97 controls the retaining element 39 with respect to the spindle element 47. A movement of the clamping pin 97 in an axial direction along the guide cutouts 99 results in a forced movement of the retaining element 39 with respect to the spindle element 47. The clamping pin 97 is intended to slide in an axial direction along the output axis A, in particular along the guide cutout(s) 99, with respect to the spindle element 47 and the retaining element 39. As a result, by means of the cam mechanism 91, the retaining element 39 can be forced to move relative to the spindle element 47. The guide unit 95 has a plurality of guide cutouts 99, which have in particular a straight course, a helical course or a course that is curved in some other way. A movement of the retaining element 39 with respect to the spindle element 47 can be controlled depending on the orientations of the guide cutouts 99.

The cam mechanism 91 has a plurality of cam mechanism elements 93, which are formed by the retaining element 39, the preloading element 77 and/or the spindle element 47. The cam mechanism elements 93 each have a guide cutout 99. The guide cutouts 99 are intended to guide a clamping pin 97 and to control a rotary movement of the retaining unit 37 about the output axis A. By means of the guide cutouts 99, a movement of the cam mechanism element 93 can be coupled.

Preferably, the preloading element 77 has a preloading guide element 101, in particular a preloading guide groove.

Preferably, the spindle element 47 has a spindle guide element 102, in particular a spindle guide groove. Particularly preferably, the retaining element 39 has a retaining guide element 103, in particular a retaining guide groove. More preferably, the respective guide cutouts 99 are coupled to the clamping pin 97. In particular, the guide cutouts 99 are intended to control an axial movement of the retaining element and/or of the preloading element (FIG. 10) with respect to the spindle element 47 by means of the clamping pin 97 guided in or on the guide cutouts 99. In particular, the guide cutouts 99 are each in the form of slots. The slots can each be formed at least partially in a rectilinear and/or curved manner. At least one guide cutout 99 may have an extent along the output axis A which is intended to delimit an axial movement of the retaining element 39. In particular, the clamping pin 97 is intended to be guided along the guide cutouts 99 such that a movement of the retaining element 39 with respect to the preloading element 77 and the spindle element 47 is allowed, in order to move the quick clamping device 23 from a clamping state into a releasing state and vice versa.

In particular, an interaction of the guide unit 95 and the clamping unit 51 has the effect that the retaining element 39 is controlled from a releasing state into a clamping state or from a releasing state into a retaining state or a clamping state and vice versa.

In FIGS. 2 to 9, the clamping pin is intended to be plugged through the preloading guide element 101, the spindle guide element 102 and the retaining guide element 103 and to be guided in an axial direction along the guide element, in order to allow a forced movement of the retaining element with respect to the spindle element. In addition, an axial movement of the retaining element with respect to the spindle element is delimited by the clamping element 61 and the further clamping element 63. The two clamping elements 61, 63 form two threads with the two intermediate clamping elements 81, 83. The guide elements 99, 101, 102, 103 are formed in a curved manner, in particular at least partially rectilinear and/or curved manner, such that, during a transition from a releasing state into a retaining state, a thread is blocked and further thread is released, and during a transition from a retaining state into a clamping state, both threads are released.

The quick clamping device 23 has a spring element 105 which is intended to preload the retaining element 39 in a releasing state with respect to the preloading element 77 and/or the spindle element 47. The spring element 105 is in the form of a tension/compression spring. The spring element 105 is mounted in a cavity of the retaining element 39. The spring element 105 is intended to preload the clamping pin 97 or the unlocking bolt 29. The spring element 105 is preloaded to a greater extent in a releasing state than in a clamping state.

The quick clamping device 23 may have a further spring element 107 which is intended to preload the preloading element 77 in a circumferential direction about the output axis A with respect to the spindle element 47 (FIG. 10). The further spring element 107 is in the form of a torsion spring. The torsion spring surrounds the retaining element 39 in a plane through 360°. The further spring element 107 may follow the preloading element 77 in an axial direction. The further spring element 107 is intended to preload the preloading element 77 in a clamping state with respect to the spindle element 47. The further spring element 107 is in this case tensioned to a greater extent in a clamping state than in a releasing state. The torsion spring is preloaded or relaxed with respect to the spindle element 47 depending on a rotational movement of the retaining element 39. The torsion spring has two legs. A first leg is connected to the preloading element 77 by way of a form fit and is arranged in an axially extending shaped cutout 109 in the preloading element 77. A second leg is connected indirectly or directly to the spindle element 47 by way of a form fit, in particular for conjoint rotation, and is arranged in an axially extending further shaped cutout.

The invention claimed is:

1. A quick clamping device for arranging an accessory device on a hand-held power tool, comprising:

an output unit configured to move the accessory device about an output axis of the output unit, and a retaining unit having a retaining element configured to retain the accessory device on the hand-held power tool, wherein the quick clamping device has a retaining state, in which the retaining unit is configured to retain the accessory device on the output unit and the retaining element is rotationally movable relative to the output shaft, and a clamping state, in which the retaining unit is configured to fix the accessory device to the output unit and the retaining unit is translationally movable relative to the output shaft, wherein, (i) in the retaining state, the retaining element is configured to exhibit a rotational movement relative to the output shaft about the output axis that is greater than the rotational movement of the retaining element relative to the output shaft about the output axis in the clamping state, and (ii) in the clamping state, the retaining element is configured to exhibit a translational movement relative to the output shaft about the output axis that is greater than the translational movement of the retaining element relative to the output shaft about the output axis in the retaining state.

2. The quick clamping device as claimed in claim 1, wherein, in the retaining state, the retaining element is disabled from movement relative to the output unit along the output axis.

3. The quick clamping device as claimed in claim 1, wherein, in the clamping state, the retaining element is disabled from movement relative to the output unit about the output axis.

4. The quick clamping device as claimed in claim 1, wherein the retaining element is configured to engage through the accessory device and to clamp the accessory device.

5. A hand-held power tool comprising:

the quick clamping device as claimed in claim 1.

6. The quick clamping device as claimed in claim 1, wherein the hand-held power tool is an angle grinder.

7. The quick clamping device as claimed in claim 1, wherein;

the retaining element has a releasing state in which the accessory device is released and removable from the retaining element, the retaining element has a transition point at which the retaining element transitions between the retaining state and the clamping state, the retaining element has a clamped-in-place position at which the accessory device is clamped in place by the retaining element, and the retaining element is configured such that the translational movement of the retaining element with respect to the output unit along the output axis from the transition point to the clamped-in-place state is greater than the translational movement of the retaining element from the releasing state to the transition point.

8. The quick clamping device as claimed in claim 1, wherein;

the retaining element has a releasing state in which the accessory device is released and removable from the retaining element, the retaining element has a transition point at which the retaining element transitions between the retaining state and the clamping state, the retaining element has a clamped-in-place position at which the accessory device is clamped in place by the retaining element, and the retaining element is configured such that the rotational movement of the retaining element with respect to the output unit about the output axis from the releasing state to the transition point is greater than the rotational movement of the retaining element from the transition point to the clamped-in-place state.

9. The quick clamping device as claimed in claim 1, further comprising a preloading element configured to control the retaining parameter of the retaining unit.

10. The quick clamping device as claimed in claim 9, further comprising a spring element configured to preload the retaining element with respect to the preloading element.

11. The quick clamping device as claimed in claim 1, further comprising a cam mechanism configured to move the retaining element relative to the output unit in a direction of rotation about the output axis.

12. The quick clamping device as claimed in claim 11, wherein the cam mechanism has a guide unit configured to control rotary movement of the retaining element with respect to a spindle element.

13. The quick clamping device as claimed in claim 12, further comprising a spring element configured to preload the retaining element with respect to the spindle element.

14. The quick clamping device as claimed in claim 1, further comprising a clamping unit configured to move the retaining element along the output axis.

15. The quick clamping device as claimed in claim 14, wherein:

the clamping unit includes a clamping element, and the clamping element is formed in one piece with the retaining element or the clamping element is in the form of a separate clamping ring coupled to the retaining element.

16. The quick clamping device as claimed in claim 14, wherein the clamping unit has a first sloping element.

17. The quick clamping device as claimed in claim 16, wherein the first sloping element has a first sloping portion and a second sloping portion, the second sloping portion being angled with respect to the first sloping portion.

18. The quick clamping device as claimed in claim 16, wherein the clamping unit has a second sloping element configured to cooperate indirectly or directly with the first sloping element.

19. The quick clamping device as claimed in claim 18, wherein the first sloping element includes a first thread or ramp element, the second sloping element includes a second thread or ramp element, and the first thread or ramp element is configured to cooperate indirectly or directly with the second thread or ramp element.

* * * * *